US009177520B2

(12) United States Patent
Shibata et al.

(10) Patent No.: US 9,177,520 B2
(45) Date of Patent: Nov. 3, 2015

(54) DISPLAY DEVICE

(75) Inventors: Yoshinori Shibata, Osaka (JP); Kohji Saitoh, Osaka (JP); Masami Ozaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 68 days.

(21) Appl. No.: 14/232,721

(22) PCT Filed: Aug. 7, 2012

(86) PCT No.: PCT/JP2012/070120

§ 371 (c)(1),
(2), (4) Date: Jan. 14, 2014

(87) PCT Pub. No.: WO2013/022007

PCT Pub. Date: Feb. 14, 2013

(65) Prior Publication Data

US 2014/0168289 A1 Jun. 19, 2014

(30) Foreign Application Priority Data

Aug. 11, 2011 (JP) ..... 2011-176171

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.

CPC ..... *G09G 3/3648* (2013.01); *G09G 3/3406* (2013.01); *G09G 3/3688* (2013.01); *G09G 2300/0452* (2013.01); *G09G 2320/028* (2013.01); *G09G 2320/0673* (2013.01)

(58) Field of Classification Search

CPC ..... G09G 3/3688; G09G 2300/0452; G09G 3/3648; G09G 2320/0673; G09G 3/3406; G09G 2320/028

USPC ..... 345/690

See application file for complete search history.

(56) References Cited

U.S. PATENT DOCUMENTS

| | | | | |
|---|---|---|---|---|
| 2005/0276088 | A1 | 12/2005 | Moon et al. | |
| 2007/0279372 | A1 * | 12/2007 | Brown Elliott et al. | 345/102 |
| 2013/0321483 | A1 * | 12/2013 | You et al. | 345/690 |

FOREIGN PATENT DOCUMENTS

JP 2005-352483 A 12/2005

OTHER PUBLICATIONS

Official Communication issued in International Patent Application No. PCT/JP2012/070120, mailed on Sep. 11, 2012.

* cited by examiner

*Primary Examiner* — Charles V Hicks
(74) *Attorney, Agent, or Firm* — Keating & Bennett, LLP

(57) ABSTRACT

In a display device (1) according to an aspect of the present invention, at least part of an N-M first sub pixel(s) is/are driven according to one of first and second gamma curve groups being selected depending on a position(s) where said at least part of the N-M first sub pixel(s) is/are located, and at least part of a second sub pixel(s) is/are driven according to one of the first and second gamma curve groups being selected depending on a position(s) where said at least part of the second sub pixel(s) is/are located.

11 Claims, 23 Drawing Sheets

* "b" STANDS FOR "BLIGHT" AND "d" STANDS FOR "DARK".

DISPLAY DEVICE

TECHNICAL FIELD

The present invention relates to a display device including a display panel provided with a plurality of pixels.

BACKGROUND ART

In the field of a display panel provided in, e.g., a liquid crystal display device, there is a demand for a technique for improving visibility of the display panel when the display panel is viewed at an angle, for the purpose of improving a viewing angle.

Patent Literature 1 describes a liquid crystal display device including (i) a liquid crystal panel including a large number of pixels including a first pixel group and a second pixel group and (ii) a data driving section for respectively providing the first pixel group and the second pixel group with tone voltages corresponding to a first data signal and a second data signal that are for different gamma constants.

However, the conventional technique described in Patent Literature 1 involves a problem of displaying an image that is not an image desired to be displayed.

With reference to FIGS. 21 and 22, the following describes an example where a geometric pattern showing a black oblique line, for example, is displayed as a result of driving of the pixels according to the above-described conventional technique. FIG. 21 illustrates a display region of a conventional display device. FIG. 22 illustrates an image that is to be displayed in the display region shown in FIG. 21 but is not yet displayed by driving the pixels according to gamma curves having gamma characteristics being different for different pixels, that is, an image which is an original image to be displayed.

A display region 330 shown in FIGS. 21 and 22 includes a plurality of pixels 331 arranged in stripes. The description here deals with a configuration in which each of the pixels 331 is constituted by four sub pixels 341, 342, 343, and 344 displaying red (R), green (G), blue (B), and white (W), respectively.

The following method is considered as an example of the driving method carried out according to the above-described conventional technique, i.e., according to the gamma curves having different gamma characteristics for different pixels: As shown in FIG. 22, each of adjacent ones of the pixels 331 is driven with use of (i) a gamma curve having a gamma characteristic having a high (bright) relative luminance for each tone and (ii) a gamma curve having a gamma characteristic having a low (dark) relative luminance for each tone. However, with this method, there occurs a case where all pixels 331 located in positions (indicated by dotted-line rectangles in FIG. 22) corresponding to the oblique line that is to be displayed are driven according to the gamma curve having the bright gamma characteristic. This leads to a problem of failing to display the oblique line that is to be displayed.

Further, the sub pixels displaying different colors have different viewing angle characteristics and different chromaticity characteristics. This leads to a problem that a color is viewed differently (color deviation) between a case where the display region is viewed from the front and a case where the display region is viewed at an angle. FIG. 19 illustrates a positional relationship between (i) a case where the display region 330 is viewed from the front (front viewing) and (ii) a case where the display region 330 is viewed at a viewing angle of 60° (viewing at 60°). FIG. 20 illustrates RGBW tone characteristics observed when the display region of the conventional display device is viewed at a viewing angle of 60°, the conventional display device being adjusted so that its RGBW tone characteristics observed when the display region is viewed from the front become closer to a gamma curve C10 ($\gamma$=2.2) that is observed at a gamma characteristic of 2.2. Note that, in FIG. 20, a curve C11 indicates an R tone characteristic, a curve C12 indicates a G tone characteristic, a curve C13 indicates a B tone characteristic, and a curve C14 indicates a W tone characteristic.

As shown in FIG. 20, even in the case where the RGBW tone characteristics observed when the display region is viewed from the front are adjusted so as to be equal to each other, the RGBW tone characteristics observed when the display region is viewed at an angle become different. As is clear from this, the sub pixels displaying different colors have different viewing angle characteristics and different chromaticity characteristics.

In order to solve the problem of the color deviation in the above-described conventional technique, driving the sub pixels with use of the gamma curves individually adjusted for all the colors may be possible. However, this method involves another problem of making a configuration of an image processing section complicated.

With reference to FIG. 23, the following describes an image processing section employing the method of driving the sub pixels with use of the gamma curves individually adjusted for all the colors. FIG. 23 is a block diagram illustrating a configuration of an image processing section 322 in the conventional display device.

The image processing section 322 includes an RGBW developing section 351 and a tone characteristic adjusting section 352. The RGBW developing section 351 generates, from RGB data received from a video data processing section (not shown), red data (hereinafter, abbreviated as "R data"), green data (hereinafter, abbreviated as "G data"), blue data (hereinafter, abbreviated as "B data"), and white data (hereinafter, abbreviated as "W data").

The tone characteristic adjusting section 352 includes an R data processing section 353, a G data processing section 354, a B data processing section 355, and a W data processing section 356. The R data processing section 353 carries out a process of generating adjusted R data from the R data generated in the RGBW developing section 351 in order that the sub pixels for displaying red are driven according to a gamma curve individually adjusted for the sub pixels for displaying red. In a similar manner, the G data processing section 354 processes the G data, the B data processing section 355 processes the B data, and the W data processing section 356 processes the W data.

Thus, in order to drive the sub pixels with use of the gamma curves individually adjusted for all the colors, individual adjustments for RGBW are necessary. This increases a circuit scale in the image processing section, thereby leading to additional problems of, e.g., an increase in the cost and an increase in the power consumption.

CITATION LIST

Patent Literatures

[Patent Literature 1]
Japanese Patent Application Publication, Tokukai, No. 2005-352483 A (Publication Date: Dec. 22, 2005)

SUMMARY OF INVENTION

Technical Problem

In order to deal with the above problems, the inventors of the present invention have proposed, in Japanese Patent Application Publication, Tokugan, No. 2010-234626 A, a display device for driving only W data displaying pixels according to a gamma curve being different from a predetermined gamma curve, so as to reduce a circuit scale.

According to this configuration, it is possible to (i) improve the viewing angle characteristic as compared with a configuration in which all of R, G, B, and W data are driven according to a predetermined gamma curve, and to (ii) reduce the circuit scale, the cost, and the power consumption as compared with the configuration that all of R, G, B, and W data are driven according to gamma curves being different from a predetermined gamma curve.

However, the inventors themselves found that their proposal above still has a problem of insufficient improvement in the viewing angle characteristic.

More specifically, the above proposal has the following problem: When viewed at an angle, a color of a displayed image is expressed differently from that observed when viewed from the front.

The present invention was made based on the above finding made by the inventors. An object of the present invention is to provide a display device capable of further improving the viewing angle characteristic while preventing an increase in the circuit scale.

Solution to Problem

In order to attain the above object, a display device of the present invention is a display device including: a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected depending on a position(s) where said at least part of the N-M first sub pixel(s) is/are located, and (ii) at least part of a second sub pixel(s) is/are driven according to one of the first and second gamma curve groups, the one of the first and second gamma curve groups being selected depending on a position(s) where said at least part of the second sub pixel(s) is/are located, the first gamma curve group being different from the common gamma curve, the second gamma curve group being different from the common gamma curve and the first gamma curve group.

According to the above configuration, the M first sub pixel(s) among the N first sub pixels, which are included in each pixel and display different colors, are uniformly driven by the driving means with use of the common gamma curve. This prevents occurrence of the conventional problems, e.g., the problem of failing to display an oblique line that is to be displayed.

Further, the driving means drives at least part of the plurality of pixels so that, in each of said at least part of the plurality of pixels, (i) at least part of an N-M first sub pixel(s) is/are driven according to one of two different gamma curve groups, the one of the two different gamma curve groups being selected depending on a position(s) where said at least part of the N-M first sub pixel(s) is/are located, and (ii) at least part of a second sub pixel(s) is/are driven according to one of the two different gamma curve groups, the one of the two different gamma curve groups being selected depending on a position(s) where said at least part of the second sub pixel(s) is/are located. This allows gamma characteristics of the N-M first sub pixels to compensate for each other and allows gamma characteristics of the second sub pixels to compensate for each other, thereby preventing the color deviation which may occur when the display panel is viewed at an angle. This makes it possible to improve the viewing angle characteristic.

The driving means drives, among the sub pixels included in each pixel, the M first sub pixel(s) according to the common gamma curve uniformly. Further, the driving means drives, among the sub pixels included in each pixel, only the N-M first sub pixel(s) and the second sub pixel(s) according to corresponding ones of the plurality of gamma curves including the two different gamma curves, the corresponding ones of the plurality of gamma curves being respectively selected depending on positions where the N-M first sub pixel(s) and the second sub pixel(s) are located. As compared with a configuration in which all the sub pixels included in each pixel are driven according to corresponding ones of the plurality of gamma curves including the two different gamma curves, the above configuration allows the driving means to have a simple configuration. This makes it possible to provide a reduction in the circuit scale, a reduction in cost, and a reduction in electric power consumption.

Note that the first gamma curve group includes one or more gamma curves being different from the common gamma curve, and the second gamma curve group includes one or more gamma curves being different from the common gamma curve and the one or more gamma curves included in the first gamma curve group.

Further, in order to attain the above object, a display device of the present invention is a display device including: a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected in each frame, and (ii) at least part of a second sub pixel(s) is/are driven according to one of the first and second gamma curve groups, the one of the first and second gamma curve groups being selected in each frame, the first gamma curve group being different from the common gamma curve, the second gamma curve group being different from the common gamma curve and the first gamma curve group.

According to the above configuration, the M first sub pixel(s) among the N first sub pixels, which are included in each pixel and display different colors, are uniformly driven by the driving means with use of the common gamma curve. This prevents occurrence of the conventional problems, e.g., the problem of failing to display an oblique line that is to be displayed.

Further, the driving means drives at least part of the plurality of pixels so that, in each of said at least part of the plurality of pixels, (i) at least part of an N-M first sub pixel(s) is/are driven according to one of two different gamma curve groups, the one of the two different gamma curve groups being selected in each frame, and (ii) at least part of a second sub pixel(s) is/are driven according to one of the two different gamma curve groups, the one of the two different gamma curve groups being selected in each frame. This allows gamma characteristics of the N-M first sub pixels to compensate for each other and allows gamma characteristics of the second sub pixels to compensate for each other, thereby preventing the color deviation which may occur when the display panel is viewed at an angle. This makes it possible to improve the viewing angle characteristic.

The driving means drives, among the sub pixels included in each pixel, the M first sub pixel(s) according to the common gamma curve uniformly. Further, the driving means drives, among the sub pixels included in each pixel, only the N-M first sub pixel(s) and the second sub pixel(s) according to corresponding ones of the plurality of gamma curves including the two different gamma curves, the corresponding ones of the plurality of gamma curves being selected in each frame. As compared with a configuration in which all the sub pixels included in each pixel are driven according to corresponding ones of the plurality of gamma curves including the two different gamma curves, the above configuration allows the driving means to have a simple configuration. This makes it possible to provide a reduction in the circuit scale, a reduction in cost, and a reduction in electric power consumption.

Further, according to the above configuration, it is possible to further improve the viewing angle characteristic and also to bring about a viewing angle compensation effect along a time axis. Consequently, it is possible to provide better visibility when the display panel is viewed at an angle and to display an image more smoothly. Further, it is possible to prevent impairment in a visually-sensed resolution (i.e., a resolution sensed by a person who watches the image) more reliably.

Advantageous Effects of Invention

As described above, a display device according to one aspect of the present invention is a display device including: a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected depending on a position(s) where said at least part of the N-M first sub pixel(s) is/are located, and (ii) at least part of a second sub pixel(s) is/are driven according to one of the first and second gamma curve groups, the one of the first and second gamma curve groups being selected depending on a position(s) where said at least part of the second sub pixel(s) is/are located, the first gamma curve group being different from the common gamma curve, the second gamma curve group being different from the common gamma curve and the first gamma curve group.

Further, a display device according to one aspect of the present invention is a display device including: a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected in each frame, and (ii) at least part of a second sub pixel(s) is/are driven according to one of the first and second gamma curve groups, the one of the first and second gamma curve groups being selected in each frame, the first gamma curve group being different from the common gamma curve, the second gamma curve group being different from the common gamma curve and the first gamma curve group.

According to the configurations according to the above aspects of the present invention, it is possible to further improve the viewing angle characteristic while preventing an increase in the circuit scale.

DESCRIPTION OF EMBODIMENTS

[Embodiment 1]

The following gives a detailed description of one embodiment of the present invention.

(Configuration of Display Device 1)

Figure 1:
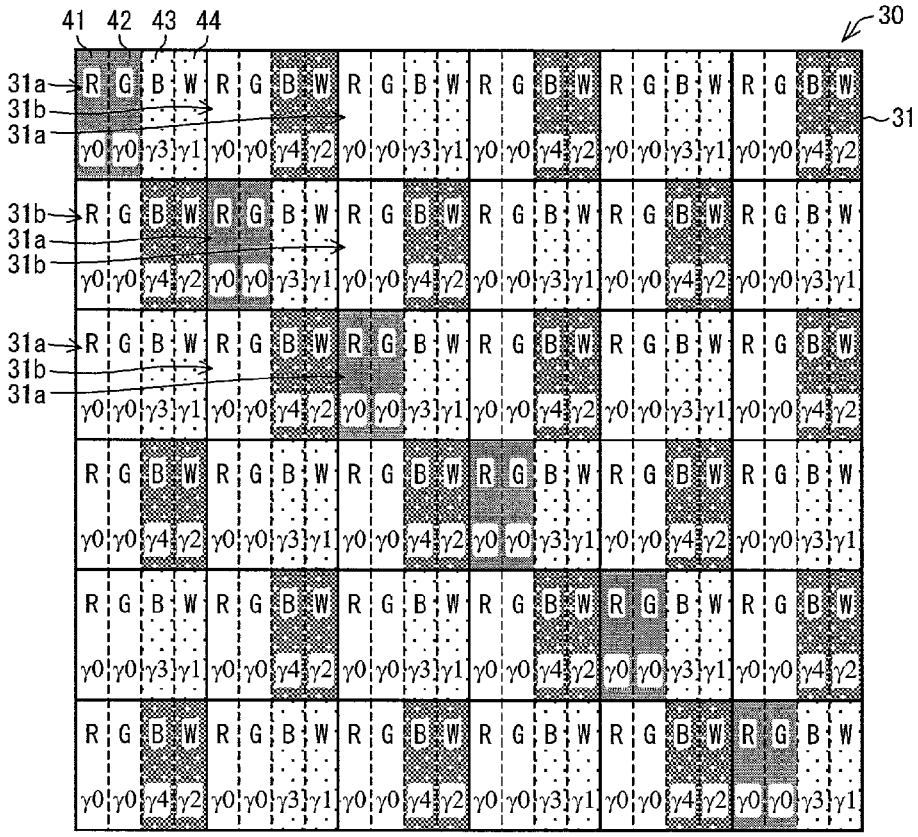
FIG. 1 illustrates a display region in one embodiment of a display device according to one aspect of the present invention.
Figure 2:
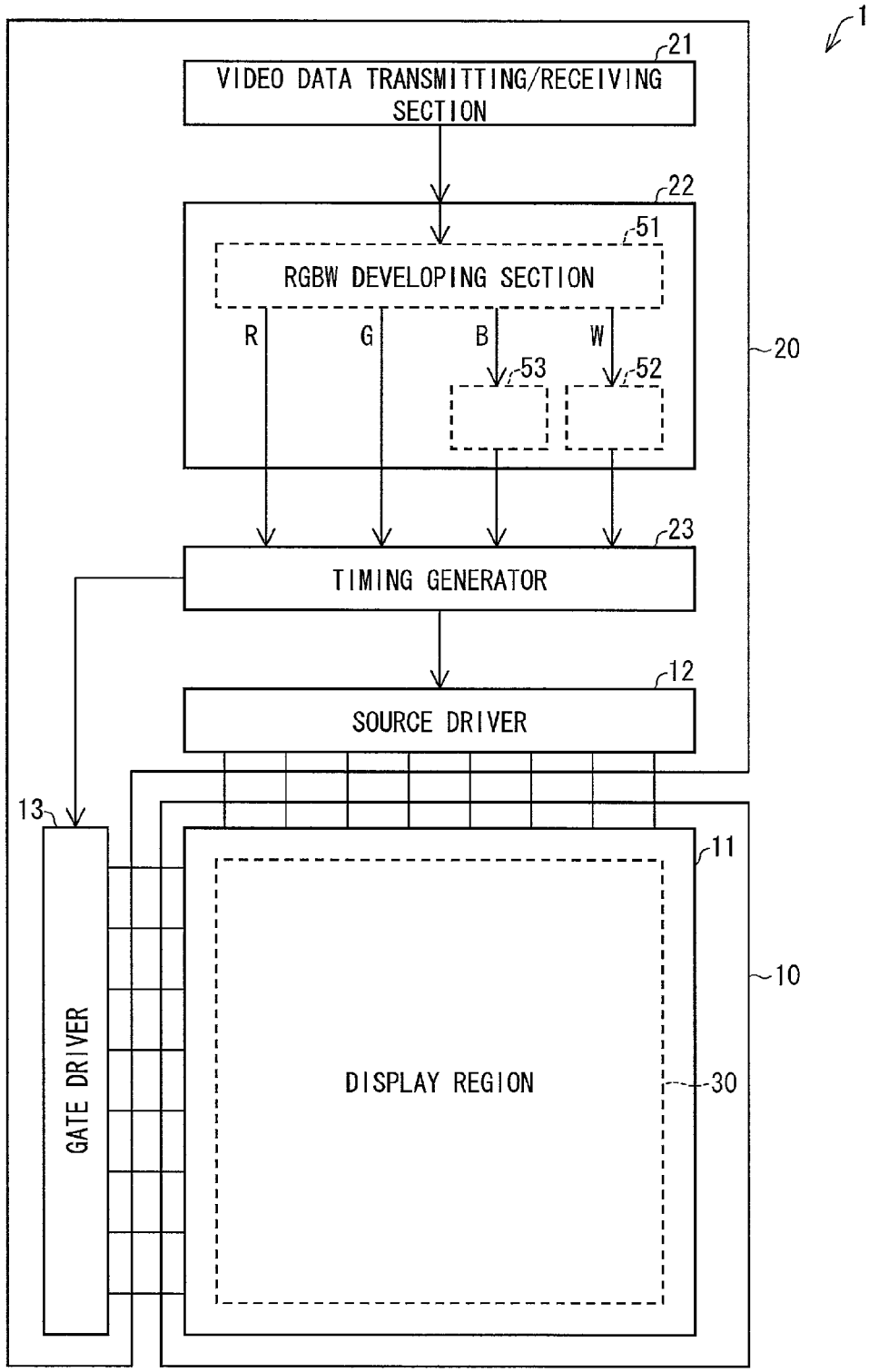
FIG. 2 is a block diagram illustrating a configuration of the one embodiment of the display device according to the one aspect of the present invention.

First, with reference to FIGS. 1 and 2, the following describes a configuration of a display device 1 of the present embodiment. FIG. 1 illustrates a display region in one embodiment of a display device according to the present invention. FIG. 2 is a block diagram illustrating a configuration of the one embodiment of the display device according to the present invention.

As shown in FIG. 2, the display device 1 of the present embodiment includes a display panel 10 and a driving section (driving means) 20. The display panel 10 includes a display section 11 including a display region 30 provided with a plurality of pixels 31.

The present embodiment deals with a configuration in which the plurality of pixels 31 are arranged in a matrix. However, the present invention is not limited to this. Alternatively, the plurality of pixels may be arranged in a delta pattern, for example.

Each of the plurality of pixels 31 is constituted by (i) N (N is a natural number of two or more) first sub pixels for displaying different colors and (ii) a second sub pixel for displaying a mixture of colors displayed by any ones of the N first sub pixels.

The present embodiment deals with a case where N=3. Specifically, the present embodiment describes an example where each of the pixels 31 is constituted by four sub pixels including (i) three first sub pixels, an R pixel (red pixel) 41 for displaying red, a G pixel (green pixel) 42 for displaying green, and a B pixel (blue pixel) 43 for displaying blue, and (ii) a second sub pixel, a W pixel (white pixel) 44 for displaying white. Further, in the present embodiment, the R pixel 41, the G pixel 42, the B pixel 43, and the W pixel 44 are aligned in one direction in one (1) pixel 31.

The W pixel 44 is a sub pixel for displaying white, which is a mixture of red, green, and blue respectively displayed by three sub pixels, the R pixel 41, the G pixel 42, and the B pixel 43.

The present embodiment deals with the configuration in which one (1) pixel is constituted by three first sub pixels and one second sub pixel. However, the present invention is not particularly limited to this. In the present invention, one (1) pixel may include two first sub pixels or four or more first sub pixels, and may include two or more second sub pixels.

The present embodiment deals with the configuration in which the first sub pixels and the second sub pixel are aligned in one direction in one (1) pixel. However, the present invention is not particularly limited to this. Alternatively, in one (1) pixel, the first sub pixels and the second sub pixel may be arranged, e.g., in a p×q matrix or in a delta pattern, where each of the letters "p" and "q" indicates a natural number of two or more, and "p" and "q" may be equal to each other or different from each other.

The colors displayed by the plurality of first sub pixels included in one (1) pixel only need to be different from each other. A combination of the colors displayed by the plurality of first sub pixels is not limited to the above-described combination, red, green, and blue. However, the combination is preferably constituted by primary colors. Examples of the combination of the colors displayed by the plurality of first sub pixels encompass a combination of cyan, magenta, and yellow.

The present embodiment deals with the configuration in which the second pixel displays white. However, the present invention is not particularly limited to this. The second pixel of the present invention only needs to be the one displaying a mixture of colors displayed by any ones of the first sub pixels. The first sub pixels whose colors are to be mixed may be arbitrarily selected. Further, the number of first sub pixels whose colors are to be mixed only needs to be two or more. The first sub pixels whose colors are to be mixed may be all of or a part of the first sub pixels included in one (1) pixel.

The expression "mixture of colors" herein refers to a color made by mixing colors respectively displayed by any ones of the first sub pixels. In a case where the colors respectively displayed by any ones of the first sub pixels are red, green, and blue, the color displayed by the second sub pixel is preferably white, for the purpose of efficiently preventing the color deviation occurring when the display panel is viewed at an angle. Alternatively, the color displayed by the second sub pixel may be yellow or cyan, for example. In a case where the plurality of first sub pixels respectively display cyan, magenta, and yellow, the color displayed by the second sub pixel may be white, for example.

Among the N first sub pixels, the driving section 20 drives an M (M is a natural number of $1 \leq M \leq N-1$) first sub pixel(s) according to a target gamma curve (common gamma curve)

having a target gamma characteristic (predetermined gamma characteristic) (described later).

The present embodiment deals with an example where M=2. Namely, two (herein, the R pixel 41 and the G pixel 42) of the first sub pixels are driven according to the target gamma curve, and one (N−M=3−2) (herein, the B pixel 43) of the first sub pixels and the second sub pixel (herein, the W pixel 44) are driven according to respective gamma curves being different from the target gamma curve.

As shown in FIG. 2, the driving section 20 includes a video data transmitting/receiving section 21, an image processing section 22, a timing generator 23, a source driver 12, and a gate driver 13. With this configuration, the driving section 20 drives the plurality of pixels 31, specifically, the R pixels 41, the G pixels 42, the B pixels 43, and the W pixels 44, which are the plurality of sub pixels included in the pixels 31.

The video data transmitting/receiving section 21 receives video data and transmits the video data to the image processing section 22. The image processing section 22 includes an RGBW developing section 51, a W tone characteristic adjusting section 52, and a B tone characteristic adjusting section 53.

The RGBW developing section 51 receives the video data from the video data transmitting/receiving section 21. Further, according to a tone (input tone) of the video data, the RGBW developing section 51 generates R data, G data, B data, and W data, which are pieces of tone data respectively corresponding to relative luminances that are to be outputted by the R pixel 41, the G pixel 42, the B pixel 43, and the W pixel 44. Then, the RGBW developing section 51 transmits the R data and the G data to the timing generator 23 without carrying out any further process. Further, the RGBW developing section 51 transmits the B data to the B tone characteristic adjusting section 53, and transmits the W data to the W tone characteristic adjusting section 52.

The RGBW developing section 51 uniformly generates the R data, the G data, the B data, and the W data according to a target gamma curve (common gamma curve) C0 which is preset. The target gamma curve C0 is a curve having a target gamma characteristic γ0. Note that information about the target gamma curve which is preset may be stored in a storing section (not shown), for example.

The "target gamma curve" herein refers to a gamma curve that is used in a case where all the pixels 31 in the display panel 10 are driven according to a single gamma curve. The "target gamma characteristic" refers to a gamma characteristic of the target gamma curve. For example, the target gamma curve may be such a gamma curve that is derived from characteristics and/or the like of the display device 1 by a generally-employed method so that fine visibility is obtained when the display panel 10 is viewed from the front.

The present embodiment deals with a case where the predetermined gamma characteristic is the target gamma characteristic and the common gamma curve is equal to the target gamma curve. However, the present invention is not particularly limited to this. Further, the expression that "the common gamma curve is equal to the target gamma curve" has a wide concept encompassing not only a case where the common gamma curve is completely equal to the target gamma curve but also a case where, even if the common gamma curve is not completely equal to the target gamma curve, the common gamma curve and the target gamma curve bring about substantially the same effect. Namely, if a common gamma curve gives substantially the same effect as that of the target gamma curve even in a case where the common gamma curve is slightly different from the target gamma curve, that common gamma curve corresponds to a gamma curve being equal to the target gamma curve.

The target gamma characteristic γ0 is preferably 1.7 or more but not more than 2.7. This makes it possible to provide fine visibility.

The target gamma curve C0 may be a curve having one inflection point. This makes it possible to further enhance the effect that the gamma characteristics compensate for each other, thereby providing fine visibility. Further, this gives a rapid change in tone-luminance characteristic of a halftone, which is often used in a natural image, thereby enhancing a visual contrast (contrast feeling).

The W tone characteristic adjusting section 52 converts pieces of W data for their respective W pixels 44 into individual pieces of adjusted W data. Specifically, first, the W tone characteristic adjusting section 52 obtains information indicative of a condition (W setting condition) being preset so that the W pixels 44 are associated with corresponding ones of the plurality of gamma curves. After the W tone characteristic adjusting section 52 associates the W pixels 44 with the corresponding ones of the plurality of gamma curves according to the information indicative of the W setting condition, the W tone characteristic adjusting section 52 respectively converts the pieces of W data for the respective W pixels 44 into the pieces of adjusted W data according to the gamma curves with which the W pixels 44 are associated. Then, the W tone characteristic adjusting section 52 transmits, to the timing generator 23, the pieces of adjusted W data for the W pixels 44.

The B tone characteristic adjusting section 53 converts pieces of B data for their respective B pixels 43 into individual pieces of adjusted B data. Specifically, as well as the W tone characteristic adjusting section 52, the B tone characteristic adjusting section 53 first obtains B setting condition information indicative of a condition (B setting condition) being preset so that the B pixels 43 are associated with corresponding ones of the plurality of gamma curves. After the B tone characteristic adjusting section 53 associates the B pixels 43 with the corresponding ones of the plurality of gamma curves according to the B setting condition information, the B tone characteristic adjusting section 53 respectively converts the pieces of B data for the respective B pixels 43 into the pieces of adjusted B data according to the gamma curves with which the B pixels 43 are associated. Then, the B tone characteristic adjusting section 53 transmits the pieces of adjusted B data to the timing generator 23. Note that the W setting condition information and the B setting condition information may be stored in a storing section (not shown), for example.

The timing generator 23 transmits the received R data, G data, adjusted B data, and adjusted W data to the source driver 12. Further, the timing generator 23 transmits, to the gate driver 13, signals based on which timings of driving the pixels 31 are respectively determined.

According to the signals received from the timing generator 23, the gate driver 13 drives the pixels 31. The source driver 12 converts, into analog voltages to be actually applied to the pixels, the R data, the G data, the adjusted B data, and the adjusted W data received from the timing generator 23. Further, the source driver 12 outputs the analog voltages to the respective pixels 31.

Namely, the driving section 20 uniformly drives the R pixels 41 and the G pixels 42 according to the target gamma curve which is preset. Further, the driving section 20 drives the B pixels 43 according to the gamma curves with which the B pixels 43 are associated, and drives the W pixels 44 according to the gamma curves with which the W pixels 44 are associated.

Thus, with the present embodiment, two pixels, the R pixel 41 and the G pixel 42, which display different colors, red and green, are driven by the driving section 20 according to the target gamma curve C0. This eliminates the possibility of failing to display an oblique line that is to be displayed.

Further, the driving section 20 drives the B pixel 43 according to one of the plurality of gamma curves, and drives the W pixel 44 according to one of the plurality of gamma curves. Here, the plurality of gamma curves include at least (i) a first gamma curve group having a first gamma characteristic being different from the target gamma characteristic γ0 and (ii) a second gamma curve group having a second gamma characteristic being different from the gamma characteristic γ0 and the first gamma characteristic.

The first gamma curve group includes, e.g., a gamma curve C1 having a gamma characteristic γ1 for driving the W pixel 44 and a gamma curve C3 having a gamma characteristic γ3 for driving the B pixel 43. The second gamma curve group includes, e.g., a gamma curve C2 having a gamma characteristic γ2 for driving the W pixel 44 and a gamma curve C4 having a gamma characteristic γ4 for driving the B pixel 43.

The gamma characteristic γ1 and the gamma characteristic γ3 may be equal to each other or may be different from each other. Similarly, the gamma characteristic γ2 and the gamma characteristic γ4 may be equal to each other or may be different from each other.

The driving section 20 drives the pixels 31 in such a manner that (i) at least part of the W pixels 44 according to one of the gamma curves C1 and C2 and (ii) at least part of the B pixels 43 according to one of the gamma curves C3 and C4. Namely, the driving section 20 drives at least part of the W pixels 44 by a halftone gray scale method using the gamma curves C1 and C2, and drives at least part of the B pixels 43 by the halftone gray scale method using the gamma curves C3 and C4.

This allows gamma characteristics of the W pixels 44 to compensate for each other, and allows gamma characteristics of the B pixels 43 to compensate for each other. This prevents the color deviation which may occur when the display region 30 is viewed at an angle, thereby improving a viewing angle. Note that the plurality of gamma curves for driving the W pixels 44 may include another gamma curve which is not the gamma curve C1 or C2, and the plurality of gamma curves for driving the B pixels 43 may include another gamma curve which is not the gamma curve C3 or C4.

Here, the "halftone gray scale method" refers to such a method by which each of a plurality of pixels (sub pixels) is driven with use of one of a plurality of gamma curves having different gamma characteristics. The halftone gray scale method selects the one gamma curve that is to be used to drive each pixel (i) depending on a spatial position where the pixel is located (method 1) or (ii) in each frame (method 2). In the present invention, one of these methods 1 and 2 may be used alone or both of them may be used in combination.

As described above, the driving section 20 drives, among the sub pixels included in the pixels 31, only the B pixels 43 and the W pixels 44 according to the halftone gray scale method. As compared with the configuration in which all the sub pixels are driven by the halftone gray scale method, the above configuration allows the driving section 20 to have a reduced circuit scale and a simplified configuration, and also makes it possible to reduce the cost and electric power consumption.

Here, the B setting condition may be (i) such the one according to which the B pixels 43 are associated with corresponding ones of the gamma curves being selected according to spatial positions at which the B pixels 43 are located or (ii) such the one according to which the B pixels 43 are associated with corresponding ones of the gamma curves being selected in each frame of an image. Similarly, the W setting condition may be (i) such the one according to which the W pixels 44 are associated with corresponding ones of the gamma curves being selected according to spatial positions at which the W pixels 44 are located or (ii) such the one according to which the W pixels 44 are associated with corresponding ones of the gamma curves being selected in each frame of an image. Alternatively, the B setting condition may be such the one according to which the B pixels 43 are associated with corresponding ones of the gamma curves being selected according to spatial positions at which the B pixels 43 are located and in each frame of an image. Further, the W setting condition may be such the one according to which the W pixels 44 are associated with corresponding ones of the gamma curves being selected according to spatial positions at which the W pixels 44 are located and in each frame of an image.

(Pixel Groups 31*a* and 31*b*)

As shown in FIG. 1, in the present embodiment, each of the plurality of pixels 31 is included in a pixel group (first pixel group) 31*a* or a pixel group (second pixel group) 31*b*. The pixel group 31*a* and the pixel group 31*b* are located in different positions. According to the present embodiment, pixels 31 in the pixel group 31*a* and pixels 31 in the pixel group 31*b* are positioned so as to alternate with each other. In other words, a certain pixel 31 and a pixel 31 adjacent to the certain pixel 31 belong to different pixel groups, 31*a* and 31*b*.

The "pixel 31 adjacent to a certain pixel 31" refers to (i) a pixel 31 being provided in a row in which the certain pixel 31 is provided and in a column adjacent to a column in which the certain pixel 31 is provided or (ii) a pixel 31 being provided in a column in which the certain pixel 31 is provided and in a row adjacent to a row in which the certain pixel 31 is provided.

Note that the expression that the plurality of pixel groups "are located in different positions" means that positions where pixels in a certain pixel group are provided are different from positions where pixels in another pixel group are provided. The present embodiment deals with an example of positions of two pixel groups constituted by a plurality of pixels arranged in a matrix. However, the present invention is not particularly limited to this. Alternatively, for example, in a case where three pixel groups are constituted by a plurality of pixels arranged in a delta pattern, such a configuration may be employed in which arbitrarily-selected three pixels being arranged in a triangle include one pixel in a first pixel group, another pixel in a second pixel group, and the other pixel in a pixel third pixel group. In this case, the pixel in the first pixel group, the pixel in the second pixel group, and the pixel in the third pixel group are arranged alternately in order.

(Driving Method)

The inventors themselves found the following fact. That is, the configuration in which only pixels (W pixels) for displaying W data are driven according to a gamma curve being different from a predetermined gamma curve has a problem of insufficient improvement in the viewing angle characteristic, particularly, a problem that a displayed image is seen to be bluish when viewed at an angle.

The inventors reached the following finding. That is, a configuration in which not only the W pixels but also the pixels (B pixels) for displaying B data are driven according to a gamma curve being different from the predetermined gamma curve makes it possible to further improve the viewing angle characteristic and to reduce the possibility that a displayed image is seen to be bluish when viewed at an angle.

First, the following will explain (i) a method in which the driving section 20 drives the pixels 31 and (ii) an example of the W setting condition and the B setting condition.

The driving section 20 drives the R pixels 41 and the G pixels 42 according to the target gamma curve C0.

According to the present embodiment, the W tone characteristic adjusting section 52 in the driving section 20 associates the W pixels 44 with a gamma curve according to the W setting condition, and the B tone characteristic adjusting section 53 in the driving section 20 associates the B pixels 43 with a gamma curve according to the B setting condition having been set in advance as below. The W tone characteristic adjusting section 52 associates each W pixel 44 with a corresponding one of the two gamma curves, the gamma curve C1 having the gamma characteristic γ1 and the gamma curve C2 having the gamma characteristic γ2. The B tone characteristic adjusting section 53 associates each B pixel 43 with a corresponding one of the two gamma curves, the gamma curve C3 having the gamma characteristic γ3 and the gamma curve C4 having the gamma characteristic γ4.

More specifically, the W tone characteristic adjusting section 52 associates a W pixel 44 of each pixel 31 in the pixel group 31*a* with the gamma curve C1, and associates a W pixel 44 of each pixel 31 in the pixel group 31*b* with the gamma curve C2. The B tone characteristic adjusting section 53 associates a B pixel 43 of each pixel 31 in the pixel group 31*a* with the gamma curve C3, and associates a B pixel 43 of each pixel 31 in the pixel group 31*b* with the gamma curve C4.

Namely, the driving section 20 drives the W pixel 44 of each pixel 31 in the pixel group 31*a* according to the gamma curve C1, and drives the B pixel 43 of each pixel 31 in the pixel group 31*a* according to the gamma curve C3. Further, the driving section 20 drives the W pixel 44 of each pixel 31 in the pixel group 31*b* according to the gamma curve C2, and drives the B pixel 43 of each pixel 31 in the pixel group 31*b* according to the gamma curve C4. Namely, the driving section 20 drives each W pixel 44 according to one of two different gamma curves, the gamma curves C1 and C2, the one of the two different gamma curves being selected depending on a position where the W pixel 44 is located. Further, the driving section 20 drives each B pixel 43 according to one of two different gamma curves, the gamma curves C3 and C4, the one of the two different gamma curves being selected depending on a position where the B pixel 43 is located.

With the above configuration, the driving section 20 drives all the W pixels 44 by the halftone gray scale method according to the two gamma curves C1 and C2, which have different gamma characteristics γ1 and γ2. This makes it possible to further improve the effect that the gamma characteristics of the W pixels 44 compensate for each other, thereby further improving the viewing angle.

Further, the driving section 20 drives all the B pixels 43 by the halftone gray scale method according to the two gamma curves C3 and C4, which have different gamma characteristics γ3 and γ4. This makes it possible to further improve the effect that the gamma characteristics of the B pixels 43 compensate for each other, thereby reducing the possibility that an image displayed on the display panel 10 is seen to be bluish when viewed at an angle.

Figure 21:
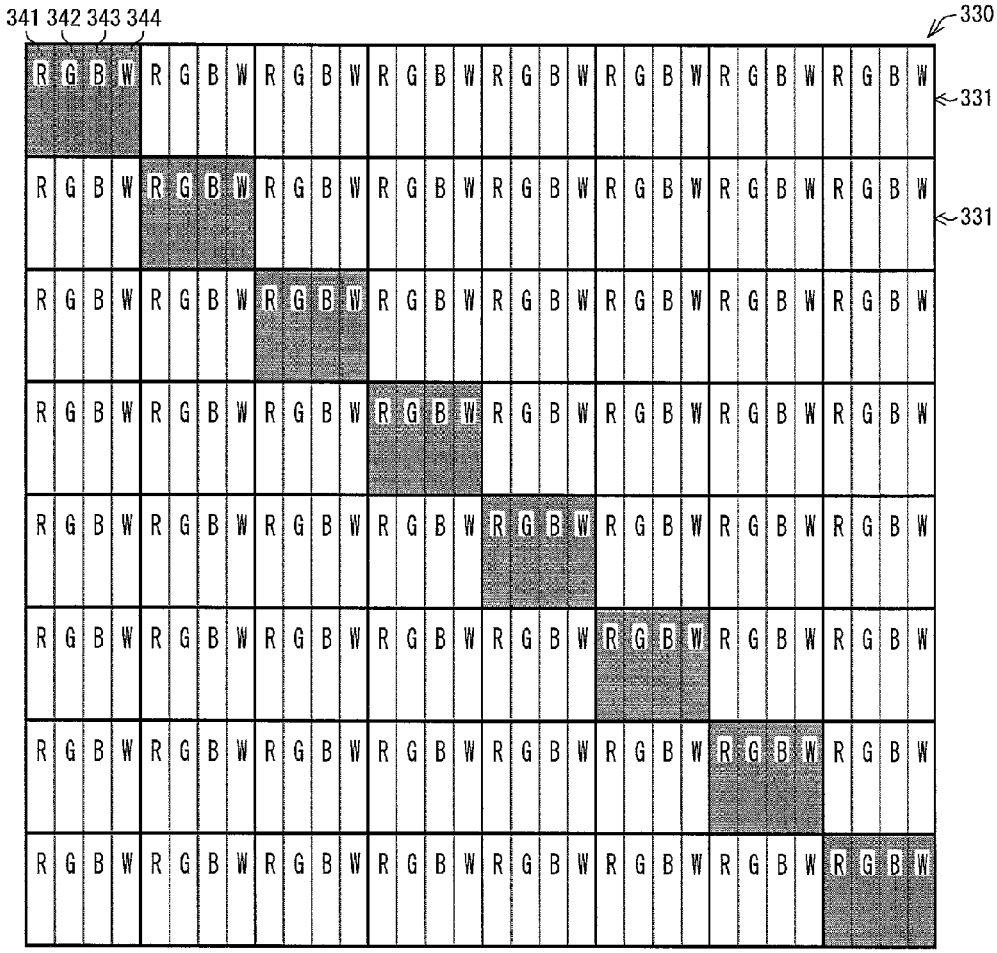
FIG. 21 PRIOR ART
FIG. 21 illustrates an image which is an original image being desired to be displayed on the display regions shown in FIGS. 13 and 14.
Figure 22:
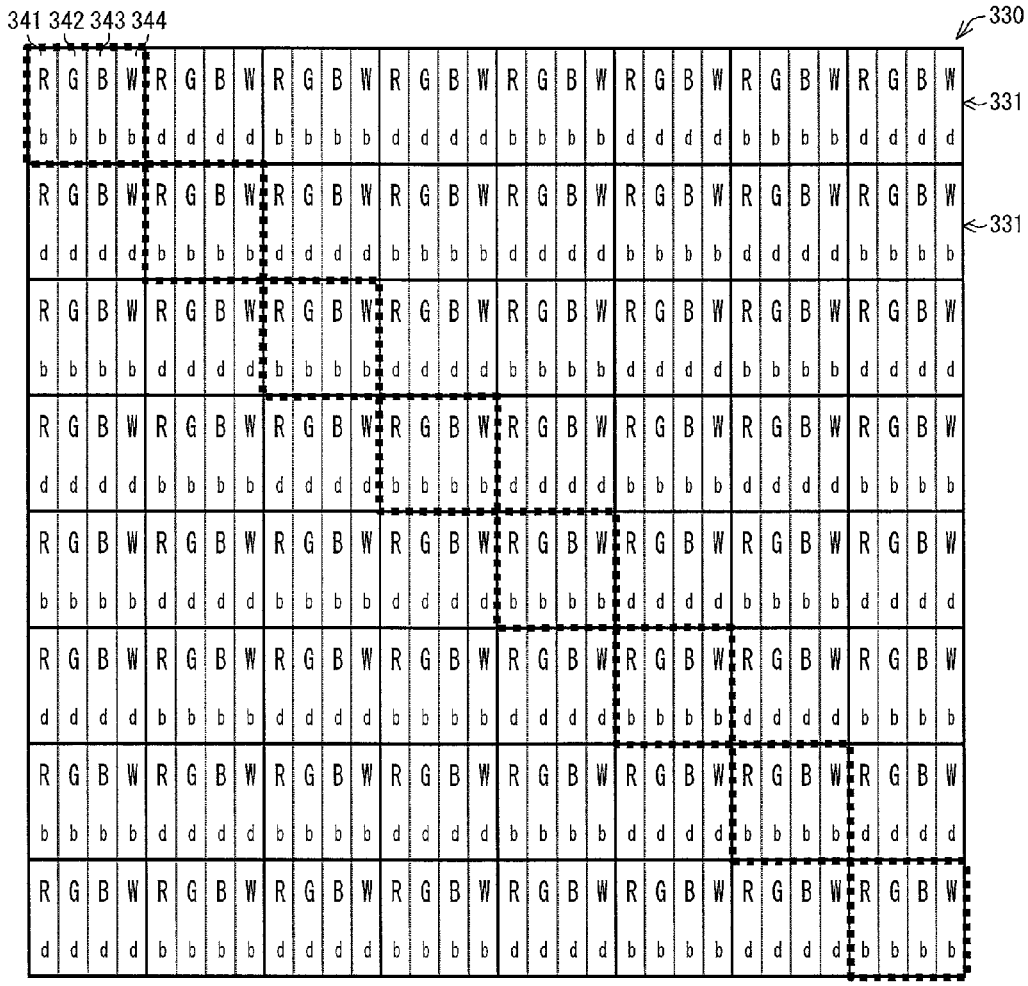
FIG. 22 PRIOR ART
FIG. 22 illustrates a display region of a conventional display device.
Figure 23:
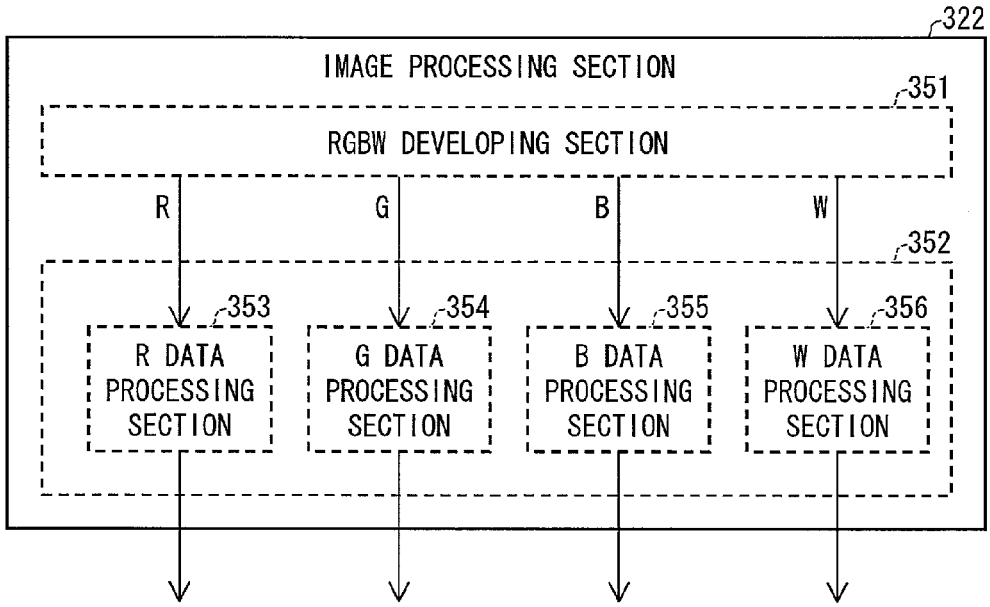
FIG. 23 PRIOR ART
FIG. 23 is a block diagram illustrating a configuration of an image processing section in the conventional display device.

Further, as shown in FIG. 1, the display device 1 of the present embodiment can display an image being closer to an oblique line which is an original image shown in FIG. 21. According to the present embodiment, the first sub pixels for displaying red and green, which are primary colors, are driven according to the target gamma curve C0. This eliminates the possibility of failing to display the oblique line. Further, this also eliminates a possibility that parts of an image are not displayed and thus a displayed image has a serrated or bumpy edge. Furthermore, this makes it possible to display an image having a color which is closer to that of an image desired to be displayed. Thus, the display device 1 can display an image which is closer to an image desired to be displayed.

Note that the driving section 20 may carry out the above-described driving method by either of the following manners: (i) In all frames, each B pixel 43 is driven according to the same gamma curve, and each W pixel 44 is driven according to the same gamma curve; (ii) In different frames, each B pixel 43 is driven according to different gamma curves, and each W pixel 44 is driven according to different gamma curves. An example where each B pixel 43 and each W pixel 44 are driven by the driving method of the present embodiment and the method involving use of different gamma curves in different frames will be described in Embodiment 5.

Figure 3:
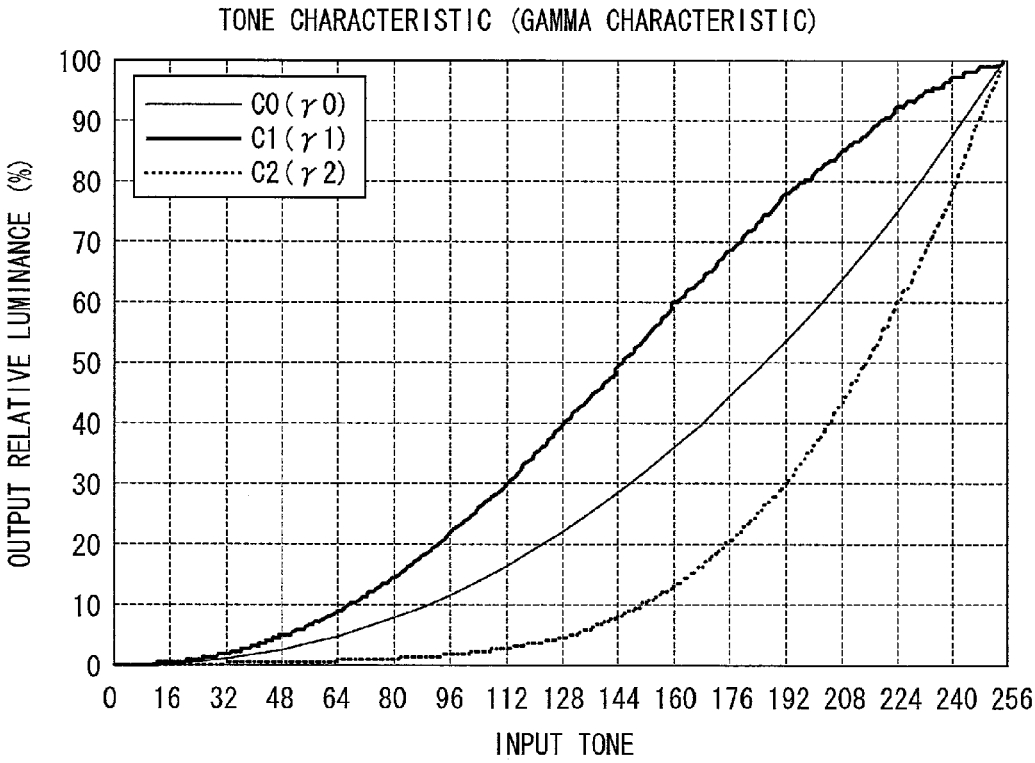
FIG. 3 is a graph showing an example of gamma characteristics of gamma curves used by a driving section in one embodiment of a display device according to an aspect of the present invention.

With reference to FIG. 3, examples of (i) the target gamma curve C0, (ii) a gamma curve included in the first gamma curve group, and (iii) a gamma curve included in the second gamma curve group will be explained. FIG. 3 is a graph showing an example of gamma characteristics (tone characteristics) of gamma curves used by the driving section in one embodiment of the present invention. In FIG. 3, the gamma curve C1 is shown as an example of the gamma curve included in the first gamma curve group, and the gamma curve C2 is shown as an example of the gamma curve included in the second gamma curve group.

In FIG. 3, the thin line indicates the target gamma curve C0, the thick line indicates the gamma curve C1, and the broken line indicates the gamma curve C2.

As shown in FIG. 3, a characteristic (i.e., a tone characteristic) for a relative luminance (output relative luminance) with respect to a tone (input tone) which characteristic is exhibited by the gamma curve C1 is higher than that of the target gamma curve C0. Further, a tone characteristic exhibited by the gamma curve C2 is lower than that of the target gamma curve C0.

In other words, a relative luminance with respect to an arbitrarily-selected tone in each gamma curve in the first gamma curve group is higher than a relative luminance with respect to the arbitrarily-selected tone in the target gamma curve C0. Further, a relative luminance with respect to an arbitrarily-selected tone in each gamma curve in the second gamma curve group is lower than a relative luminance with respect to the arbitrarily-selected tone in the target gamma curve C0.

Consequently, the gamma characteristics (tone characteristics) of the first gamma curve group and the second gamma curve group, which are used to drive (i) the B pixel 43 and W pixel 44 of each pixel 31 in the pixel group 31*a* and (ii) the B pixel 43 and W pixel 44 of each pixel 31 in the pixel group 31*b*, are compensated efficiently. This provides fine visibility when the display panel 10 is viewed at an angle, thereby further increasing the viewing angle.

Preferably, an average of (i) a relative luminance with respect to an arbitrarily-selected tone in the gamma curve C1 and (ii) a relative luminance with respect to the arbitrarily-selected tone in the gamma curve C2 is equal to a relative luminance with respect to the arbitrarily-selected tone in the target gamma curve C0. With this, the visibility obtained when the display panel 10 is viewed from the front can be made equal to that of the configuration in which all the B pixels 43 and all the W pixels 44 are driven by the target gamma curve C0. Further, the visibility obtained when the display panel 10 is viewed at an angle can be made better.

Note that the gamma curve C1 and the gamma curve C2, namely, the first gamma curve group and the second gamma curve group are not limited to those exemplified in FIG. 3, and may have the features as explained below, for example.

The first gamma curve group or the second gamma curve group may intersect the target gamma curve C0 at a certain tone. In this case, for example, a relative luminance with respect to an arbitrarily-selected tone which is in the first gamma curve group or the second gamma curve group and is lower than the certain tone may be higher than a relative luminance with respect to that tone in the target gamma curve C0. Alternatively, a relative luminance with respect to an arbitrarily-selected tone which is in the first gamma curve group or the second gamma curve group and is higher than the certain tone may be lower than a relative luminance with respect to that tone in the target gamma curve C0. Each of the pixels driven by the gamma curve groups having such the features outputs, with respect to a low tone, a relative luminance that is higher than a target relative luminance. Further, each of such the pixels outputs, with respect to a high tone, a relative luminance that is lower than the target relative luminance.

Alternatively, in the case where the first gamma curve group or the second gamma curve group intersects the target gamma curve C0 at a certain tone, a relative luminance with respect to an arbitrarily-selected tone which is in the first gamma curve group or the second gamma curve group and is lower than the certain tone may be lower than a relative luminance with respect to that tone in the target gamma curve C0, for example. Further, a relative luminance with respect to an arbitrarily-selected tone which is in the first gamma curve group or the second gamma curve group and is higher than the certain tone may be higher than a relative luminance with respect to that tone in the target gamma curve C0. Each of the pixels driven by the gamma curve groups having such the features outputs, with respect to a low tone, a relative luminance that is lower than a target relative luminance. Further, each of such the pixels outputs, with respect to a high tone, a relative luminance that is higher than the target relative luminance.

Further, a tone at which the first gamma curve group intersects the target gamma curve C0 and a tone at which the second gamma curve group intersects the target gamma curve C0 may be equal to each other or different from each other. In a case where such the tones are equal to each other, (i) a gamma characteristic of a pixel driven by the first gamma curve group and (ii) a gamma characteristic of a pixel driven by the second gamma curve group compensate for each other. This makes it possible to provide fine visibility obtained when the display panel 10 is viewed at an angle and to increase a viewing angle.

The present embodiment has dealt with the configuration in which the B pixels 43 are driven by one of the two gamma curve groups and the W pixels 44 are driven by one of the two gamma curve groups. However, the present invention is not limited to this configuration. Alternatively, the B pixels 43 may be driven by one of three or more gamma curve groups, and the W pixels 44 may be driven by one of the three or more gamma curve groups.

The present embodiment has explained, as an example, the configuration in which the W pixels 44 and the B pixels 43 are driven by the halftone gray scale method. However, the present invention is not limited to this. Alternatively, for example, the W pixels 44 and, instead of the B pixels 43, the R pixels 41 or the G pixels 42 may be driven by the halftone gray scale method. In this case, the driving section 20 only needs to include an R tone characteristic adjusting section (not shown) or a G tone characteristic adjusting section (not shown) instead of the B tone characteristic adjusting section 53.

[Embodiment 2]

Figure 4:
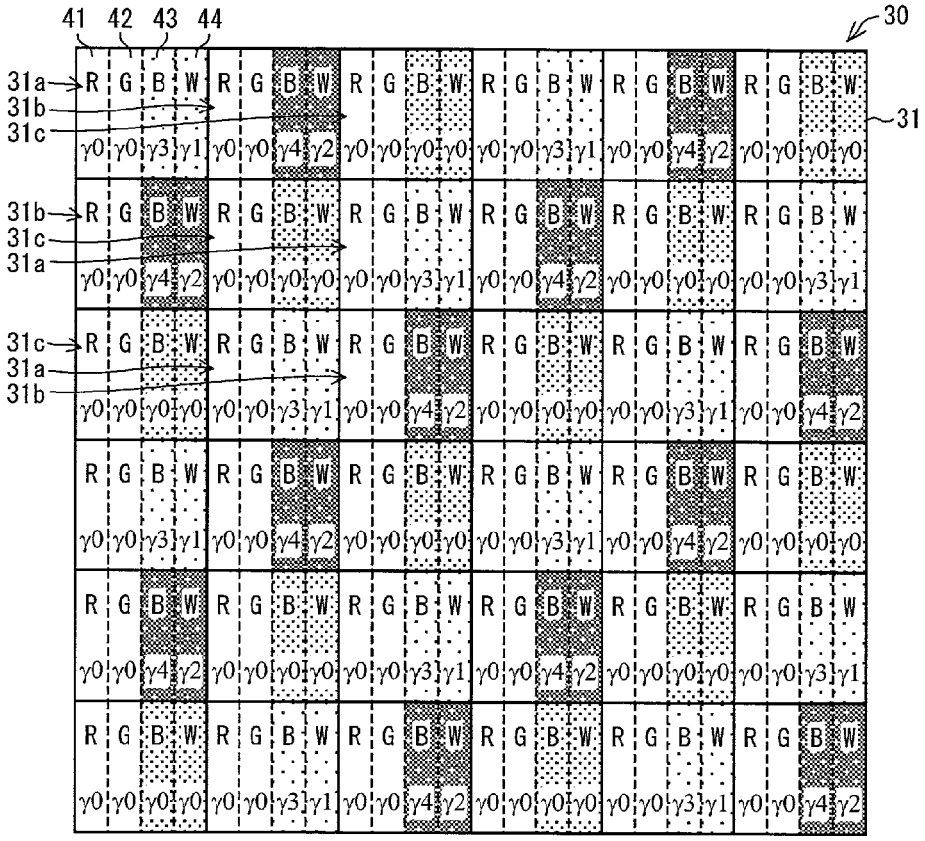
FIG. 4 illustrates a display region of another embodiment of the display device according to the one aspect of the present invention.

Next, with reference to FIG. 4, another embodiment of the present invention will be explained in detail. FIG. 4 illustrates a display region of the embodiment of the present invention.

Regarding the method in which the driving section 20 drives the pixels 31, a display device 1 of the present embodiment is different from that of Embodiment 1 only in the B setting condition and the W setting condition, particularly. Here, for convenience of explanation, elements having the same functions as those of Embodiment 1 are given the same reference signs, and explanations thereof are omitted. Mainly explained here will be differences between the present embodiment and Embodiment 1.

(Pixel groups 31*a*, 31*b*, and 31*c*)

In the present embodiment, each of a plurality of pixels 31 is included in a pixel group (first pixel group) 31*a*, a pixel group (second pixel group) 31*b*, or a pixel group 31*c*. The pixel group 31*a*, the pixel group 31*b*, and the pixel group 31*c* are located in different positions. In a display region 30, pixel sets each constituted by a pixel 31 in the pixel group 31*a*, a pixel 31 in the pixel group 31*b*, and a pixel 31 in the pixel group 31*c* arranged in this order are arrayed in row and column directions.

Namely, a certain pixel 31 and a pixel 31 adjacent to the certain pixel 31 belong to different ones of the pixel groups 31*a*, 31*b*, and 31*c*. In other words, two pixels 31 belonging to the same one of the pixel groups 31*a*, 31*b*, and 31*c* are not positioned side by side.

(Driving Method)

The driving section 20 drives R pixels 41 and G pixels 42 according to a target gamma curve C0 having a target gamma characteristic γ0.

According to a W setting condition, a W tone characteristic adjusting section 52 in the driving section 20 associates each W pixel 44 with a corresponding one of three gamma curves, the above-described gamma curve C1, and gamma curve C2, and target gamma curve C0, as described below. Further, according to a B setting condition, a B tone characteristic adjusting section 53 associates each B pixel 43 with a corresponding one of three gamma curves, the above-described gamma curves C3, gamma curve C4, and target gamma curve C0, as described below.

According to the W setting condition of the present embodiment, the W tone characteristic adjusting section 52 associates a W pixel 44 of each pixel 31 in the pixel group 31*a* with the gamma curve C1, associates a W pixel 44 of each pixel 31 in the pixel group 31*b* with the gamma curve C2, and associates a W pixel 44 of each pixel 31 in the pixel group 31*c* with the target gamma curve C0.

Namely, the driving section 20 drives the W pixel 44 of each pixel 31 in the pixel group 31*a* according to the gamma curve C1. Further, the driving section 20 drives the W pixel 44 of each pixel 31 in the pixel group 31*b* according to the gamma curve C2. Furthermore, the driving section 20 drives the W pixel 44 of each pixel 31 in the pixel group 31*c* according to the target gamma curve C0. Namely, the driving section 20 drives each W pixel 44 according to one of the gamma curves C1, C2, and C0 being selected based on a position where the W pixel 44 is located.

Further, according to the B setting condition of the present embodiment, the B tone characteristic adjusting section 53 associates a B pixel 43 of each pixel 31 in the pixel group 31*a* with the gamma curve C3, associates a B pixel 43 of each pixel 31 in the pixel group 31*b* with the gamma curve C4, and associates a B pixel 43 of each pixel 31 in the pixel group 31*c* with the target gamma curve C0.

Namely, the driving section 20 drives the B pixel 43 of each pixel 31 in the pixel group 31*a* according to the gamma curve C3. Further, the driving section 20 drives the B pixel 43 of each pixel 31 in the pixel group 31*b* according to the gamma curve C4. Furthermore, the driving section 20 drives the B pixel 43 of each pixel 31 in the pixel group 31*c* according to the target gamma curve C0. Namely, the driving section 20 drives each B pixel 43 according to one of the gamma curves C3, C4, and C0 being selected based on a position where the B pixel 43 is located.

With the above configuration, the driving section 20 drives the W pixels 44 by the halftone gray scale method using the three gamma curves C0 through C2 having respective different gamma characteristics γ1, γ2, and γ0. Further, the driving section 20 drives the B pixels 43 by the halftone gray scale method using the three gamma curves C0, C3, and C4 having respective different gamma characteristics γ3, γ4, and γ0.

This makes it possible to further improve the effect that the gamma characteristics of the W pixels 44 compensate for each other and the gamma characteristics of the B pixels 43 compensate for each other, thereby further improving the viewing angle. Further, this makes it possible to reduce the possibility that an image displayed on a display panel 10 is seen to be bluish when viewed at an angle.

Note that the driving section 20 may carry out the above-described method by either of the following manners: (i) In all frames, each B pixel 43 is driven according to the same gamma curve, and each W pixel 44 is driven according to the same gamma curve; (ii) In different frames, each B pixel 43 is driven according to different gamma curves, and each W pixel 44 is driven according to different gamma curves. An example where the driving is carried out by the driving method of the present embodiment and the method involving use of different gamma curves in different frames will be described in Embodiment 6.

The present embodiment has explained, as an example, the configuration in which the driving section 20 drives the B pixel 43 and the W pixel 44 of the pixel 31 in the pixel group 31*c* according to the target gamma curve C0. However, the present invention is not limited to this.

Alternatively, for example, such a configuration may be employed in which the driving section 20 drives the B pixel 43 and the W pixel 44 of the pixel 31 in the pixel group 31*c* according to a gamma curve C', which is included in a third gamma curve group having a third gamma characteristic being different from the first and second gamma characteristics.

The gamma curve C' may be substantially equal to the target gamma curve C0. Here, the expression that the two gamma curves are "substantially equal" has a wide concept encompassing not only a case where the two gamma curves are completely equal to each other but also a case where, even if the two gamma curves are not completely equal to each other, the two gamma curves bring about substantially the same effect.

Further, the gamma curve C' may be such the one that a relative luminance with respect to an arbitrarily-selected tone in the gamma curve C' is lower or higher than a relative luminance with respect to the arbitrarily-selected tone in the gamma curve C0.

Further, the gamma curve C' may have the features as explained below, for example.

The gamma curve C' may intersect the target gamma curve C0 at a certain tone. In this case, a relative luminance with respect to an arbitrarily-selected tone which is in the gamma curve C' and is lower than the certain tone may be lower than a relative luminance with respect to that tone in the target gamma curve C0. Further, a relative luminance with respect to an arbitrarily-selected tone which is in the gamma curve C' and is higher than the certain tone may be higher than a relative luminance with respect to that tone in the target gamma curve C0.

Alternatively, in the case where the gamma curve C' intersects the target gamma curve C0 at a certain tone, a relative luminance with respect to an arbitrarily-selected tone which in the gamma curve C' and is lower than the certain tone may be higher than a relative luminance with respect to that tone in the target gamma curve C0. Further, a relative luminance with respect to an arbitrarily-selected tone which is in the gamma curve C' and is higher than the certain tone may be lower than a relative luminance with respect to that tone in the target gamma curve C0.

The present embodiment has explained the configuration in which the driving section 20 drives the B pixels 43 according to one of the three gamma curves and drives the W pixels 44 according to one of the three gamma curves. However, the present invention is not limited to this configuration. Alternatively, such a configuration may be employed in which the driving section 20 drives the B pixels 43 according to one of four or more gamma curves and drives the W pixels 44 according to one of the four or more gamma curves.

[Embodiment 3]

Figure 5:
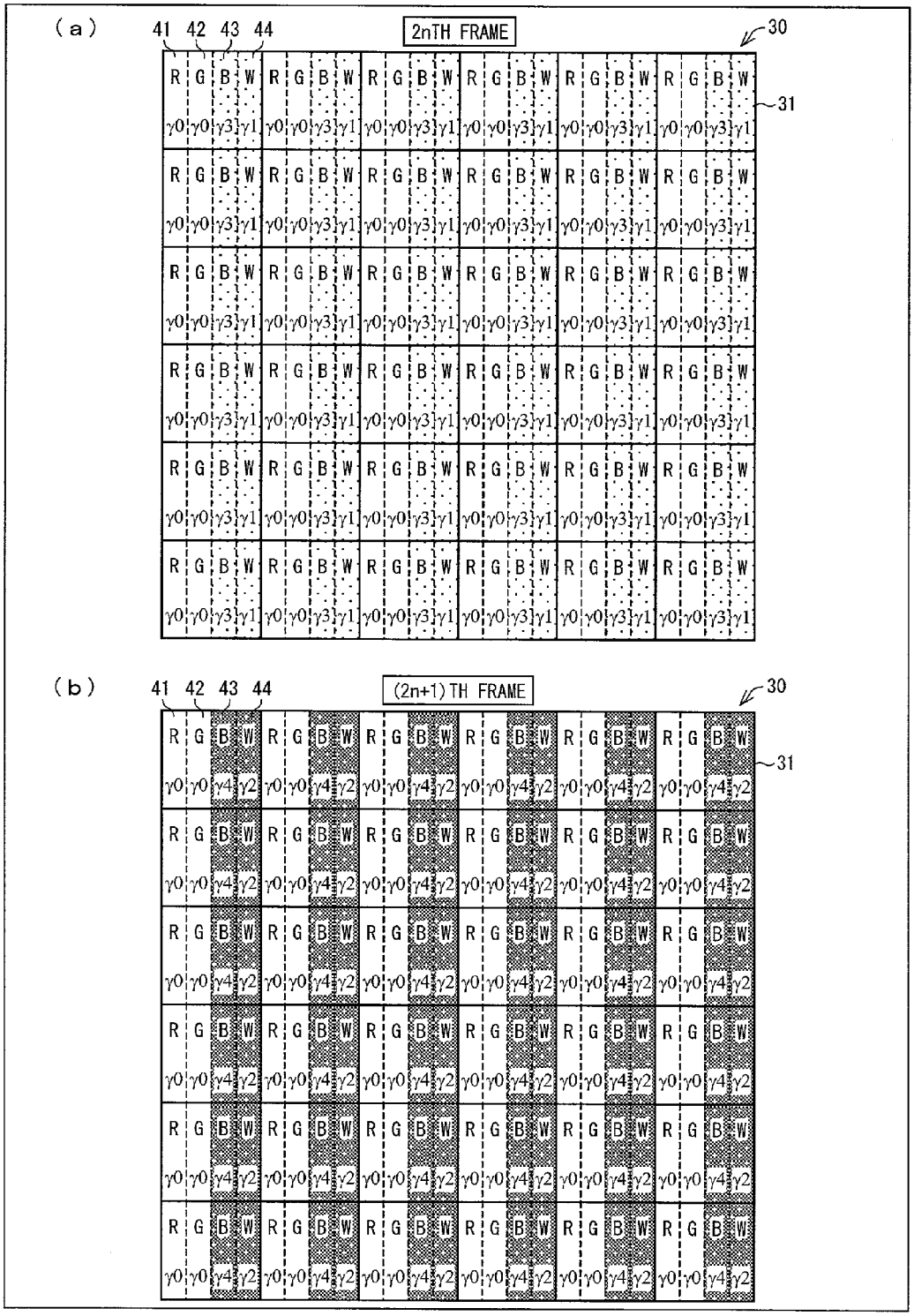
FIG. 5 illustrates a display region of another embodiment of the display device according to the one aspect of the present invention.

Next, with reference to (a) and (b) of FIG. 5, another embodiment of the present invention will be explained in detail. (a) and (b) of FIG. 5 illustrate a display region of the embodiment of the display device of the present invention. (a) of FIG. 5 illustrates a display region 30 observed in a 2n frame (n is a natural number), and (b) of FIG. 5 illustrates the display region 30 observed in a 2n+1 frame.

Regarding the method in which the driving section 20 drives the pixels 31, a display device 1 of the present embodiment is different from those of Embodiments 1 and 2 only in the B setting condition and the W setting condition, particularly. Here, for convenience of explanation, elements having the same functions as those of Embodiments 1 and 2 are given the same reference signs, and explanations thereof are omitted. Mainly explained here will be differences between (i) the present embodiment and (ii) Embodiments 1 and 2.

The driving section 20 drives R pixels 41 and G pixels 42 according to a target gamma curve C0 having a target gamma characteristic γ0.

In the present embodiment, as explained blow, according to a W setting condition, a W tone characteristic adjusting section 52 associates each W pixel 44 with one of two gamma curves, the above-described gamma curves C1 and C2, the one of the two gamma curves being selected in each frame. Further, according to a B setting condition, a B tone characteristic adjusting section 53 associates each B pixel 43 with one of two gamma curves, the above-described gamma curves C3 and C4, the one of the two gamma curves being selected in each frame.

According to the W setting condition and the B setting condition, in a case where the W tone characteristic adjusting section 52 associates a W pixel 44 with the gamma curve C1 and the B tone characteristic adjusting section 53 associates a B pixel 43 with the gamma curve C3 in the 2n frame (a frame which is immediately before a certain frame), the W tone characteristic adjusting section 52 associates the W pixel 44 with the gamma curve C2 and the B tone characteristic adjusting section 53 associates the B pixel 43 with the gamma curve C4 in the 2n+1 frame (the certain frame). In a case where the W tone characteristic adjusting section 52 associates a W pixel 44 with the gamma curve C2 and the B tone characteristic adjusting section 53 associates a B pixel 43 with the gamma curve C4 in the 2n frame, the W tone characteristic adjusting section 52 associates the W pixel 44 with the gamma curve C1 and the B tone characteristic adjusting section 53 associates the B pixel 43 with the gamma curve C3 in the 2n+1 frame.

Namely, in a case where the driving section 20 drives a B pixel 43 and a W pixel 44 according to a first gamma curve group in the 2n frame, the driving section 20 drives the B pixel 43 and the W pixel 44 according to a second gamma curve group in the 2n+1 frame. In a case where the driving section 20 drives a B pixel 43 and a W pixel 44 according to the second gamma curve group in the 2n frame, the driving section 20 drives the B pixel 43 and the W pixel 44 according to the second gamma curve group in the 2n+1 frame.

Namely, the driving section 20 drives all the B pixels 43 by the halftone gray scale method with use of one of the gamma curves included in the two different gamma curve groups being selected in each frame, and drives all the W pixels 44 by the halftone gray scale method with use of one of the gamma curves included in the two different gamma curve groups being selected in each frame.

With the above configuration, each W pixel 44 is driven according to one of the two different gamma curves C1 and C2 selected in each frame, the selection being made so that the gamma curves C1 and C2 alternate with each other. This brings about a viewing angle compensation effect along a time axis. Consequently, it is possible to provide better visibility when the display panel 10 is viewed at an angle and to display an image smoothly. Further, it is possible to prevent impairment in a visually-sensed resolution.

Furthermore, with the above configuration, each B pixel 43 is driven according to one of the two different gamma curves C3 and C4 selected in each frame, the selection being made so that the gamma curves C3 and C4 alternate with each other. This brings about a viewing angle compensation effect along a time axis. Consequently, it is possible to reduce the possibility that an image displayed on the display panel 10 is seen to be bluish when viewed at an angle.

Note that (a) and (b) of FIG. 5 illustrate a case where, in a single frame, the driving section 20 drives all the B pixels 43 in the display region 30 according to the same gamma curve and drives all the W pixels 44 in the display region 30 according to the same gamma curve. However, the present invention is not limited to this. Instead of the above-described driving method, the driving section 20 may carry out the driving in the following manner: In a single frame, the driving section 20 drives a part of the plurality of B pixels 43 according to a gamma curve being different from that for the other B pixels 43, and drives a part of the plurality of W pixels 44 according to a gamma curve being different from that for the other W pixels 44. For example, the configuration of Embodiment 1 and the configuration of the present embodiment may be employed in combination. An example of such the combination will be explained in Embodiment 5.

[Embodiment 4]

Figure 6:
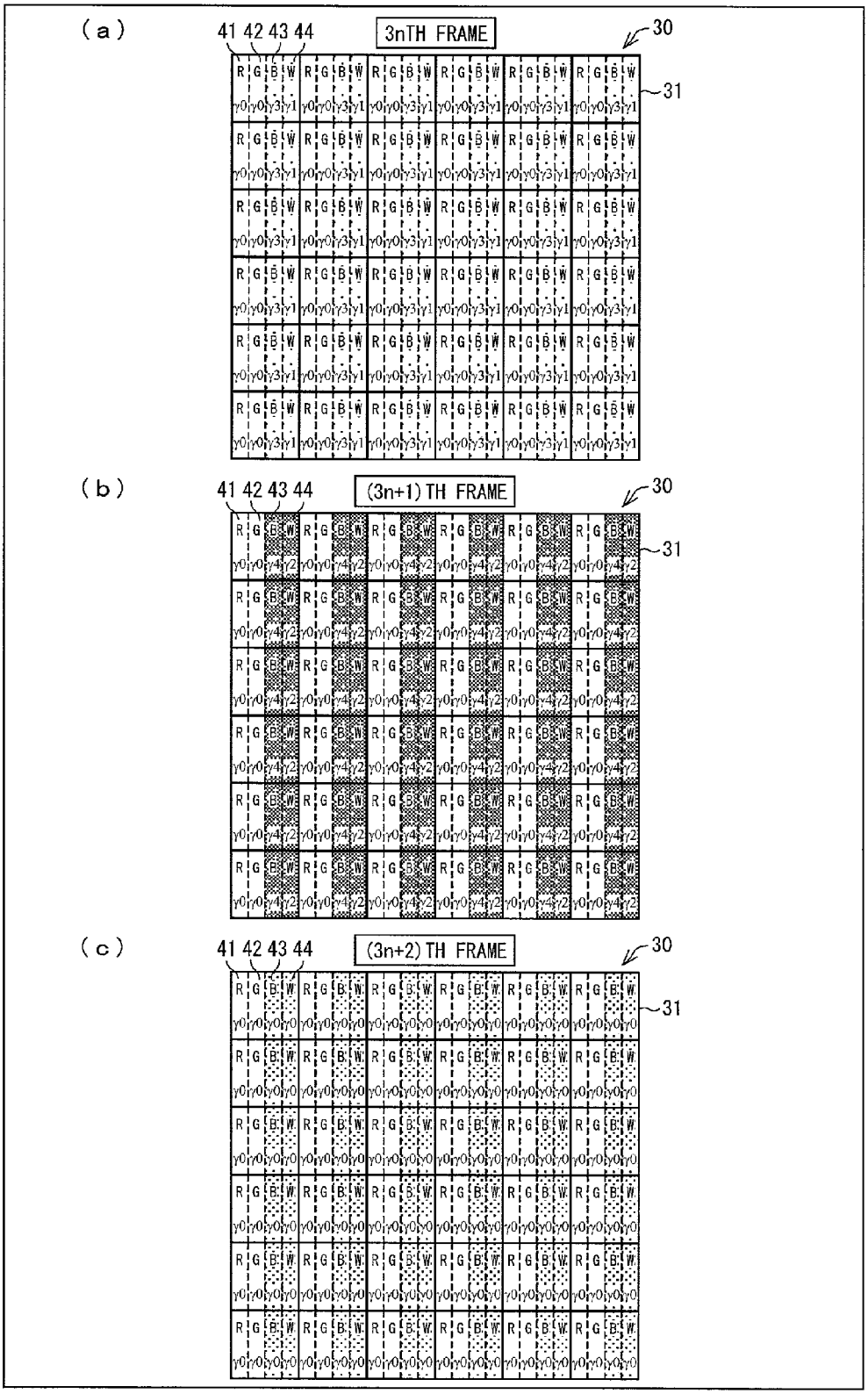
FIG. 6 illustrates a display region of another embodiment of the display device according to the one aspect of the present invention.

Next, with reference to (a) through (c) of FIG. 6, another embodiment of the present invention will be explained in detail. (a) through (c) of FIG. 6 illustrate a display region of the embodiment of the display device of the present invention. (a) of FIG. 6 illustrates a display region 30 observed in a 3n frame, (b) of FIG. 6 illustrates the display region 30 observed in a 3n+1 frame, and (c) of FIG. 6 illustrates the display region 30 observed in a 3n+2 frame.

Regarding the method in which the driving section 20 drives the pixels 31, a display device 1 of the present embodiment is different from those of Embodiments 1 through 3 only in the B setting condition and the W setting condition, particularly. Here, for convenience of explanation, elements having the same functions as those of Embodiments 1 through 3 are given the same reference signs, and explanations thereof are omitted. Mainly explained here will be differences between (i) the present embodiment and (ii) Embodiments 1 through 3.

The driving section 20 drives R pixels 41 and G pixels 42 according to a target gamma curve C0 having a target gamma characteristic γ0.

In the present embodiment, according to a W setting condition, a W tone characteristic adjusting section 52 associates each W pixel 44 with one of three gamma curves, the above-described gamma curves C0 through C2, in each frame as explained below. Further, according to a B setting condition, a B tone characteristic adjusting section 53 associates each B pixel 43 with one of three gamma curves, the above-described gamma curves C0, C3, and C4, in each frame as explained below.

According to the W setting condition and the B setting condition of the present embodiment, in a case where the W tone characteristic adjusting section 52 associates a W pixel 44 with the gamma curve C1 and the B tone characteristic adjusting section 53 associates a B pixel 43 with the gamma curve C3 in the 3n frame (a frame which is before a certain frame), the W tone characteristic adjusting section 52 associates the W pixel 44 with the gamma curve C2 and the B tone characteristic adjusting section 53 associates the B pixel 43 with the gamma curve C4 in the 3n+1 frame (the certain frame). In a case where the W tone characteristic adjusting section 52 associates a W pixel 44 with the gamma curve C2 and the B tone characteristic adjusting section 53 associates a B pixel 43 with the gamma curve C4 in the 3n frame, the W tone characteristic adjusting section 52 associates the W pixel 44 with the target gamma curve C0 and the B tone characteristic adjusting section 53 associates the B pixel 43 with the target gamma curve C0 in the 3n+1 frame. In a case where the W tone characteristic adjusting section 52 associates a W pixel 44 with the target gamma curve C0 and the B tone characteristic adjusting section 53 associates a B pixel 43 with the target gamma curve C0 in the 3n frame, the W tone characteristic adjusting section 52 associates the W pixel 44 with the gamma curve C1 and the B tone characteristic adjusting section 53 associates the B pixel 43 with the gamma curve C3 in the 3n+1 frame.

Namely, in a case where the driving section 20 drives a B pixel 43 and a W pixel 44 according to a first gamma curve group in the 3n frame, the driving section 20 drives the B pixel 43 and the W pixel 44 according to a second gamma curve group in the 3n+1 frame. In a case where the driving section 20 drives a B pixel 43 and a W pixel 44 according to the second gamma curve group in the 3n frame, the driving section 20 drives the B pixel 43 and the W pixel 44 according to the target gamma curve C0 in the 3n+1 frame. In a case where the driving section 20 drives a B pixel 43 and a W pixel 44 according to the target gamma curve C0 in the 3n frame, the driving section 20 drives the B pixel 43 and the W pixel 44 according to the first gamma curve group in the 3n+1 frame.

Namely, the driving section 20 drives the B pixels 43 by the halftone gray scale method with use of one of the gamma curves included in the two different gamma curve groups and the target gamma curve C0, the one of the gamma curves being selected in each frame. Further, the driving section 20 drives the W pixels 44 by the halftone gray scale method with use of one of the gamma curves included in the two different gamma curve groups and the target gamma curve C0, the one of the gamma curves being selected in each frame. Note that the present invention is not limited to this configuration. Alternatively, the driving section 20 may drive the B pixels 43 by the halftone gray scale method with use of one of gamma curves included in three different gamma curve groups and the target gamma curve C0, the one of the gamma curves being selected in each frame. Further, the driving section 20 may drive the W pixels 44 by the halftone gray scale method with use of one of the gamma curves included in the three different gamma curve groups and the target gamma curve C0, the one of the gamma curves being selected in each frame. Further alternatively, the driving section 20 may drive the B pixels 43 by the halftone gray scale method with use of one of four or more different gamma curve groups being selected in each frame. Further, the driving section 20 may drive the W pixels 44 by the halftone gray scale method with use of one of the four or more different gamma curve groups being selected in each frame.

With the above configuration, each W pixel 44 is driven according to one of the three different gamma curves C0 through C2 selected in each frame, the selection being made so that the gamma curves C0 through C2 are used one after another repeatedly. This brings about a viewing angle compensation effect along a time axis. Consequently, it is possible to provide better visibility when the display panel 10 is viewed at an angle and to display an image smoothly. Further, it is possible to prevent impairment in a visually-sensed resolution.

Furthermore, with the above configuration, each B pixel 43 is driven according to one of the three different gamma curves C0, C3, and C4 selected in each frame, the selection being made so that the gamma curves C0, C3, and C4 are used one after another repeatedly. This brings about a viewing angle compensation effect along a time axis. Consequently, it is possible to reduce the possibility that an image displayed on the display panel 10 is seen to be bluish when viewed at an angle.

Instead of the target gamma curve C0, the driving section 20 may carry out the driving according to a gamma curve C', which is included in a third gamma curve group having a third gamma characteristic being different from the first and second gamma characteristics. The gamma curve C' may be substantially equal to the target gamma curve C0.

(a) through (c) of FIG. 6 illustrate a case where, in each frame, the driving section 20 drives all the B pixels 43 in the display region 30 according to the same gamma curve and drives all the W pixels 44 in the display region 30 according to the same gamma curve. However, the present invention is not limited to this. Instead of the above-described driving method, the driving section may carry out the driving in the following manner: In a single frame, the driving section 20 drives a part of the plurality of B pixels 43 according to a gamma curve being different from that for the other B pixels 43, and drives a part of the plurality of W pixels 44 according to a gamma curve being different from that for the other W pixels 44. For example, the configuration of Embodiment 2 and the configuration of the present embodiment may be employed in combination. An example of such the combination will be explained in Embodiment 6.

[Embodiment 5]

Figure 7:
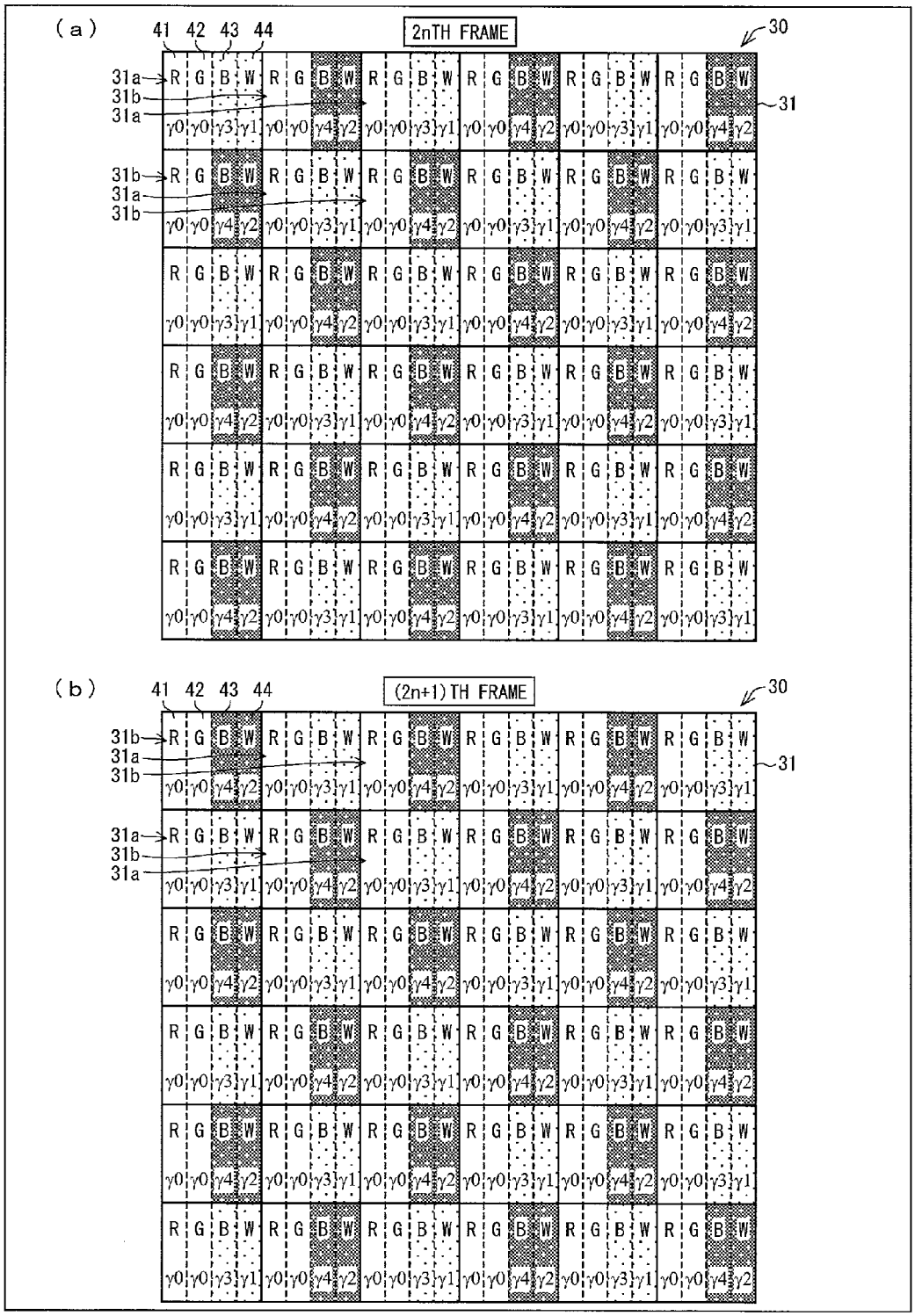
FIG. 7 illustrates a display region of another embodiment of the display device according to the one aspect of the present invention.

Next, with reference to (a) and (b) of FIG. 7, another embodiment of the present invention will be explained in detail. (a) and (b) of FIG. 7 illustrate a display region of the embodiment of the display device according to the present invention. (a) of FIG. 7 illustrates a display region 30 observed in a 2n frame, and (b) of FIG. 7 illustrates the display region 30 observed in a 2n+1 frame.

Regarding the method in which the driving section 20 drives the pixels 31, a display device 1 of the present embodiment is different from those of Embodiments 1 through 4 only in the B setting condition and the W setting condition, particularly. Here, for convenience of explanation, elements having the same functions as those of Embodiments 1 through 4 are given the same reference signs, and explanations thereof are omitted. Mainly explained here will be differences between (i) the present embodiment and (ii) Embodiments 1 through 4.

In the present embodiment, each of a plurality of pixels 31 is included in a pixel group 31*a* or a pixel group 31*b*, as well as in Embodiment 1.

The driving section 20 drives R pixels 41 and G pixels 42 according to a target gamma curve C0 having a target gamma characteristic $\gamma$0.

According to a W setting condition, a W tone characteristic adjusting section 52 associates each W pixel 44 with a corresponding one of two gamma curves, the above-described gamma curves C1 and C2. Further, according to a B setting condition, a B tone characteristic adjusting section 53 associates each B pixel 43 with a corresponding one of two gamma curves, the above-described gamma curves C3 and C4.

As well as in Embodiment 1, according to the W setting condition and the B setting condition, in a case where a W tone characteristic adjusting section 52 and a B tone characteristic adjusting section 53 associate a B pixel 43 and a W pixel 44 of each pixel 31 in the pixel group 31*a* with a first gamma curve group, the W tone characteristic adjusting section 52 and the B tone characteristic adjusting section 53 associate a B pixel 43 and a W pixel 44 of each pixel 31 in the pixel group 31*b* with a second gamma curve group. In a case where the W tone characteristic adjusting section 52 and the B tone characteristic adjusting section 53 associate a B pixel 43 and a W pixel 44 of each pixel 31 in the pixel group 31*a* with the second gamma curve group, the W tone characteristic adjusting section 52 and the B tone characteristic adjusting section 53 associate a B pixel 43 and a W pixel 44 of each pixel 31 in the pixel group 31*b* with the first gamma curve group.

Namely, in a case where the driving section 20 drives the B pixel 43 and the W pixel 44 of each pixel 31 in the pixel group 31*a* according to the first gamma curve group, the driving section 20 drives the B pixel 43 and the W pixel 44 of each pixel 31 in the pixel group 31*b* according to the second gamma curve group. Further, in a case where the driving section 20 drives the B pixel 43 and the W pixel 44 of each pixel 31 in the pixel group 31*a* according to the second gamma curve group, the driving section 20 drives the B pixel 43 and the W pixel 44 of each pixel 31 in the pixel group 31*b* according to the first gamma curve group.

Furthermore, in a case where the W tone characteristic adjusting section 52 and the B tone characteristic adjusting section 53 drive the B pixel 43 and the W pixel 44 of each pixel 31 in the pixel group 31*a* according to the first gamma curve group and drive the B pixel 43 and the W pixel 44 of each pixel 31 in the pixel group 31*b* according to the second gamma curve group in the 2n frame (a frame before a certain frame), the W tone characteristic adjusting section 52 and the B tone characteristic adjusting section 53 drive the B pixel 43 and the W pixel 44 of each pixel 31 in the pixel group 31*a* according to the second gamma curve group and drive the B pixel 43 and the W pixel 44 of each pixel 31 in the pixel group 31*b* according to the first gamma curve group in the 2n+1 frame (the certain frame).

In a case where the W tone characteristic adjusting section 52 and the B tone characteristic adjusting section 53 drive the B pixel 43 and the W pixel 44 of each pixel 31 in the pixel group 31*a* according to the second gamma curve group and drive the B pixel 43 and the W pixel 44 of each pixel 31 in the pixel group 31*b* according to the first gamma curve group in the 2n frame, the W tone characteristic adjusting section 52 and the B tone characteristic adjusting section 53 drive the B pixel 43 and the W pixel 44 of each pixel 31 in the pixel group 31*a* according to the first gamma curve group and drive the B pixel 43 and the W pixel 44 of each pixel 31 in the pixel group 31*b* according to the second gamma curve group in the 2n+1 frame.

Namely, the driving section 20 drives all the B pixels 43 by the halftone gray scale method with use of corresponding ones of the two different gamma curve groups being selected (i) depending on positions where the B pixels 43 are located and (ii) in each frame. Further, the driving section 20 drives all the W pixels 44 by the halftone gray scale method with use of corresponding ones of the two different gamma curve groups being selected (i) depending on positions where the W pixels 44 are located and (ii) in each frame.

With this configuration, it is possible to further improve the effect that gamma characteristics of the W pixels 44 compensate for each other in one frame. This makes it possible to further improve the viewing angle and also to bring about a viewing angle compensation effect along a time axis. Consequently, it is possible to provide better visibility when the display panel 10 is viewed at an angle and to display an image more smoothly. Further, it is possible to prevent impairment in a visually-sensed resolution.

Furthermore, with this configuration, it is possible to further improve the effect that gamma characteristics of the B pixels 43 compensate for each other in one frame. This brings about a viewing angle compensation effect along a time axis, thereby reducing the possibility that an image displayed on the display panel 10 is seen to be bluish when viewed at an angle.

[Embodiment 6]

Next, with reference to (a) through (c) of FIG. 8, another embodiment of the present invention will be explained in detail.

Figure 8:
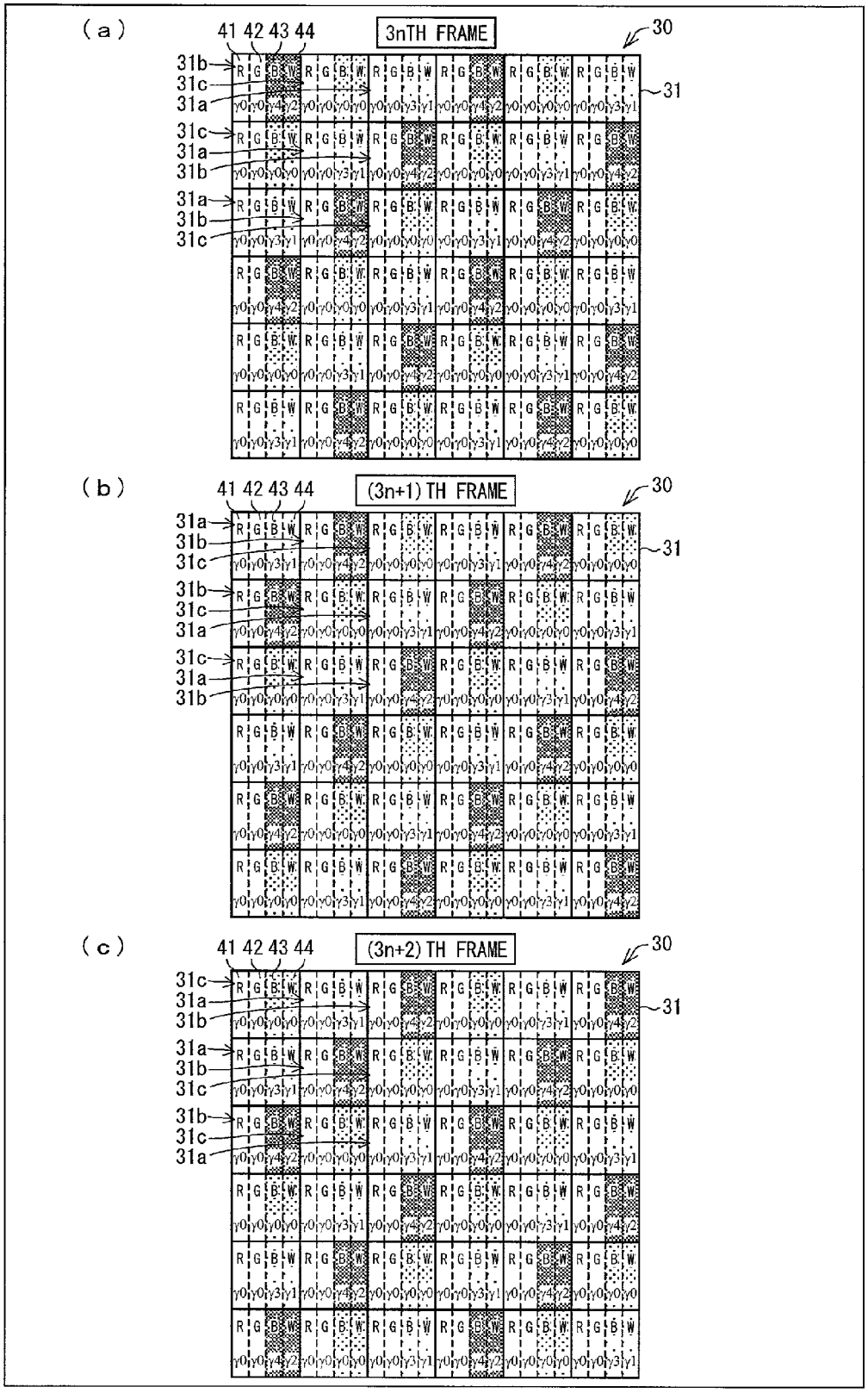
FIG. 8 illustrates a display region of another embodiment of the display device according to the one aspect of the present invention.

(a) through (c) of FIG. 8 illustrate a display region of the embodiment of the display device according to the present invention. (a) of FIG. 8 illustrates a display region 30 observed in a 3n frame, (b) of FIG. 8 illustrates the display region 30 observed in a 3n+1 frame, and (c) of FIG. 8 illustrates the display region 30 observed in a 3n+2 frame.

Regarding the method in which the driving section 20 drives the pixels 31, a display device 1 of the present embodiment is different from those of Embodiments 1 through 5 only in the B setting condition and the W setting condition, particularly. Here, for convenience of explanation, elements having the same functions as those of Embodiments 1 through 5 are given the same reference signs, and explanations thereof are omitted. Mainly explained here will be differences between (i) the present embodiment and (ii) Embodiments 1 through 5.

In the present embodiment, each of a plurality of pixels 31 is included in a pixel group 31*a*, a pixel group 31*b*, or a pixel group 31*c*, as well as in Embodiment 2.

The driving section 20 drives R pixels 41 and G pixels 42 according to a target gamma curve C0 having a target gamma characteristic γ0.

According to a W setting condition, a W tone characteristic adjusting section 52 associates each W pixel 44 with a corresponding one of three gamma curves, the above-described gamma curves C0 through C2. Further, according to a B setting condition, a B tone characteristic adjusting section 53 associates each B pixel 43 with a corresponding one of three gamma curves, the above-described gamma curves C0, C3, and C4.

According to the B setting condition and the W setting condition, the B tone characteristic adjusting section 53 and the W tone characteristic adjusting section 52 associate (i) a B pixel 43 and a W pixel 44 of each pixel 31 in the pixel group 31*a*, (ii) a B pixel 43 and a W pixel 44 of each pixel 31 in the pixel group 31*b*, and (iii) a B pixel 43 and a W pixel 44 of each pixel 31 in the pixel group 31*c* with respective different gamma curves which are selected from a gamma curve included in a first gamma curve group, a gamma curve included in a second gamma curve group, and the target gamma curve C0.

Further, according to the B setting condition and the W setting condition, in a case where the B tone characteristic adjusting section 53 and the W tone characteristic adjusting section 52 associate the B pixel 43 and the W pixel 44 of each pixel 31 in the pixel group 31*a* with the first gamma curve group, associate the B pixel 43 and the W pixel 44 of each pixel 31 in the pixel group 31*b* with the second gamma curve group, and associate the B pixel 43 and the W pixel 44 of each pixel 31 in the pixel group 31*c* with the target gamma curve C0 in the 3n frame (a frame immediately before a certain frame), the B tone characteristic adjusting section 53 and the W tone characteristic adjusting section 52 associate the B pixel 43 and the W pixel 44 of each pixel 31 in the pixel group 31*a* with the second gamma curve group, associates the B pixel 43 and the W pixel 44 of each pixel 31 in the pixel group 31*b* with the target gamma curve C0, and associates the B pixel 43 and the W pixel 44 of each pixel 31 in the pixel group 31*c* with the first gamma curve group in the 3n+1 frame (the certain frame).

In a case where the B tone characteristic adjusting section 53 and the W tone characteristic adjusting section 52 associate the B pixel 43 and the W pixel 44 of each pixel 31 in the pixel group 31*a* with the second gamma curve group, associate the B pixel 43 and the W pixel 44 of each pixel 31 in the pixel group 31*b* with the target gamma curve C0, and associate the B pixel 43 and the W pixel 44 of each pixel 31 in the pixel group 31*c* with the first gamma curve group in the 3n frame, the B tone characteristic adjusting section 53 and the W tone characteristic adjusting section 52 associate the B pixel 43 and the W pixel 44 of each pixel 31 in the pixel group 31*a* with the target gamma curve C0, associate the B pixel 43 and the W pixel 44 of each pixel 31 in the pixel group 31*b* with the first gamma curve group, and associate the B pixel 43 and the W pixel 44 of each pixel 31 in the pixel group 31*c* with the second gamma curve group in the 3n+1 frame.

In a case where the B tone characteristic adjusting section 53 and the W tone characteristic adjusting section 52 associate the B pixel 43 and the W pixel 44 of each pixel 31 in the pixel group 31*a* with the target gamma curve C0, associate the B pixel 43 and the W pixel 44 of each pixel 31 in the pixel group 31*b* with the first gamma curve group, and associate the B pixel 43 and the W pixel 44 of each pixel 31 in the pixel group 31*c* with the second gamma curve group in the 3n frame, the B tone characteristic adjusting section 53 and the W tone characteristic adjusting section 52 associate the B pixel 43 and the W pixel 44 of each pixel 31 in the pixel group 31*a* with the first gamma curve group, associate the B pixel 43 and the W pixel 44 of each pixel 31 in the pixel group 31*b* with the second gamma curve group, and associate the B pixel 43 and the W pixel 44 of each pixel 31 in the pixel group 31*c* with the target gamma curve C0 in the 3n+1 frame.

Namely, in a case where the driving section 20 drives the B pixel 43 and the W pixel 44 of each pixel 31 in the pixel group 31*a* according to the first gamma curve group, drives the B pixel 43 and the W pixel 44 of each pixel 31 in the pixel group 31*b* according to the second gamma curve group, and drives the W pixel 44 of each pixel in the pixel group 31*c* according to the target gamma curve C0 in the 3n frame, the driving section 20 drives the B pixel 43 and the W pixel 44 of each pixel 31 in the pixel group 31*a* according to the second gamma curve group, drives the B pixel 43 and the W pixel 44 of each pixel 31 in the pixel group 31*b* according to the target gamma curve C0, and drives the B pixel 43 and the W pixel 44 of each pixel 31 in the pixel group 31*c* according to the first gamma curve group in the 3n+1 frame.

In a case where the driving section 20 drives the B pixel 43 and the W pixel 44 of each pixel 31 in the pixel group 31*a* according to the second gamma curve group, drives the B pixel 43 and the W pixel 44 of each pixel 31 in the pixel group 31*b* according to the target gamma curve C0, and drives the B pixel 43 and the W pixel 44 of each pixel 31 in the pixel group 31*c* according to the first gamma curve group in the 3n frame, the driving section 20 drives the B pixel 43 and the W pixel 44 of each pixel 31 in the pixel group 31*a* according to the target gamma curve C0, drives the B pixel 43 and the W pixel 44 of each pixel 31 in the pixel group 31*b* according to the first gamma curve group, and drives the B pixel 43 and the W pixel 44 of each pixel 31 in the pixel group 31*c* according to the second gamma curve group in the 3n+1 frame.

In a case where the driving section 20 drives the B pixel 43 and the W pixel 44 of each pixel 31 in the pixel group 31*a* according to the target gamma curve C0, drives the B pixel 43 and the W pixel 44 of each pixel 31 in the pixel group 31*b* according to the first gamma curve group, and drives the B pixel 43 and the W pixel 44 of each pixel 31 in the pixel group 31*c* according to the second gamma curve group in the 3n frame, the driving section 20 drives the B pixel 43 and the W pixel 44 of each pixel 31 in the pixel group 31*a* according to the first gamma curve group, drives the B pixel 43 and the W pixel 44 of each pixel 31 in the pixel group 31*b* according to the second gamma curve group, and drives the W pixel 44 of each pixel 31 in the pixel group 31*c* according to the target gamma curve C0 in the 3n+1 frame.

Namely, the driving section 20 drives each B pixel 43 by the halftone gray scale method according to a corresponding one of the three gamma curves, including the gamma curves in the two different gamma curve groups and the target gamma curve C0, the one of the three gamma curves being selected (i) depending on a position where the B pixel 43 is located and (ii) in each frame. Further, the driving section 20 drives each W pixel 44 by the halftone gray scale method according to a corresponding one of the three gamma curves, the one of the three gamma curves being selected (i) depending on a position where the W pixel 44 is located and (ii) in each frame. Note that the present invention is not limited to this configuration. Alternatively, the driving section 20 may drive each B pixel 43 and each W pixel 44 by the halftone gray scale method involving use of gamma curves included in three different gamma curve groups and the target gamma curve C0. Further alternatively, the driving section 20 may drive each B pixel 43 and each W pixel 44 by the halftone gray scale method involving use of four or more different gamma curves.

According to the above configuration, the driving section 20 drives, with use of the three gamma curves having different gamma characteristics, the B pixels 43 and the W pixels 44 of the pixels included in the three pixel groups 31*a*, 31*b*, and 31*c* which are located in different positions. Further, the driving section 20 drives each B pixel 43 with use of one of the three different gamma curves being selected in each frame, and drives each W pixel 44 with use of one of the three different gamma curves being selected in each frame.

According to this configuration, it is possible to further improve the effect that the gamma characteristics of the W pixels 44 compensate for each other in one frame. This makes it possible to further improve the viewing angle and to bring about a viewing angle compensation effect along a time axis. Consequently, it is possible to provide better visibility when the display panel 10 is viewed at an angle and to display an image more smoothly. Further, it is possible to prevent impairment in a visually-sensed resolution.

Further, according to this configuration, it is possible to further improve the effect that the gamma characteristics of the B pixels 43 compensate for each other in one frame. This makes it possible to reduce the possibility that an image displayed on a display panel 10 is seen to be bluish when viewed at an angle.

[Embodiment 7]

Figure 9:
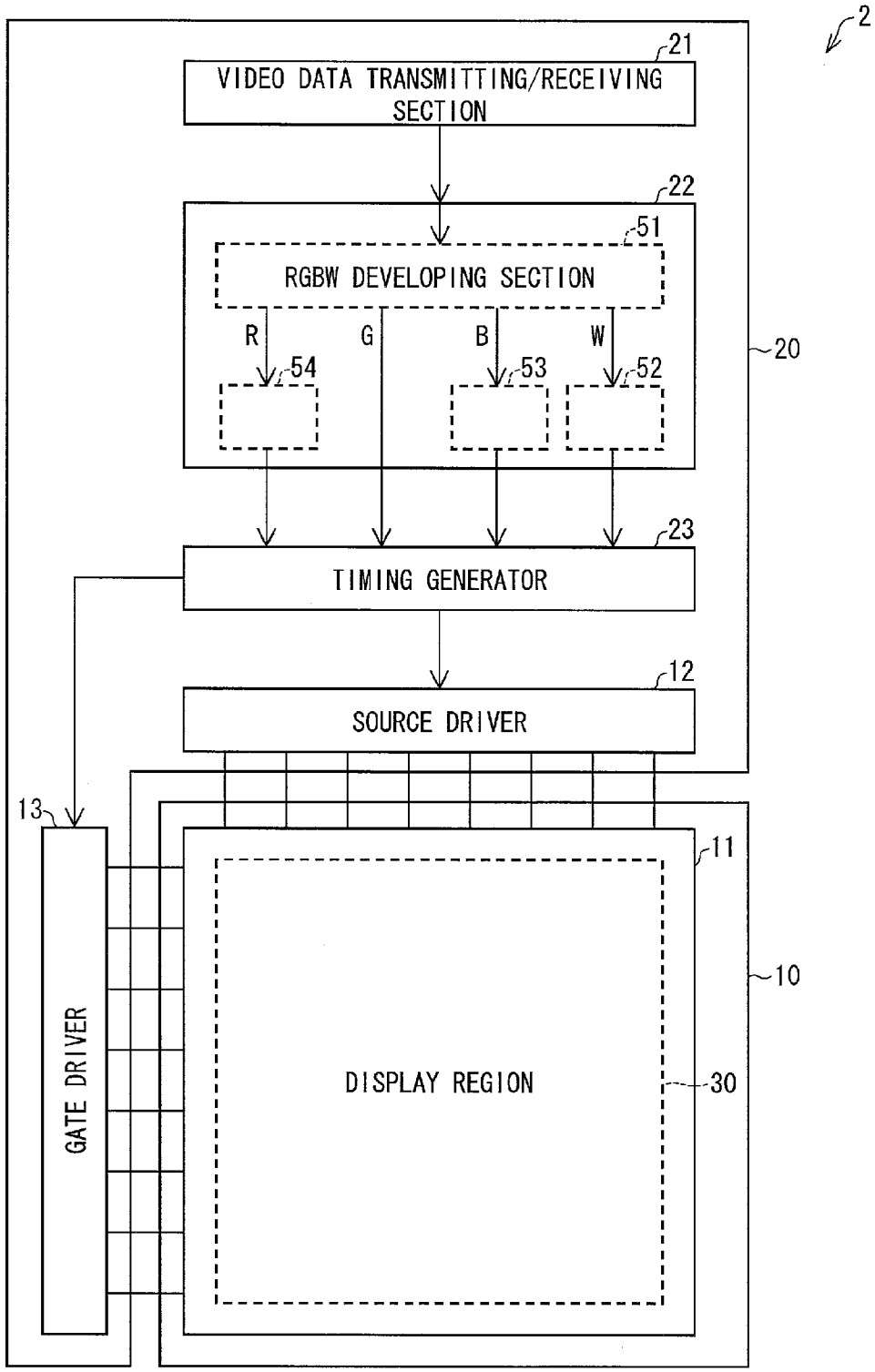
FIG. 9 is a block diagram illustrating a configuration of another embodiment of the display device according to the one aspect of the present invention.
Figure 10:
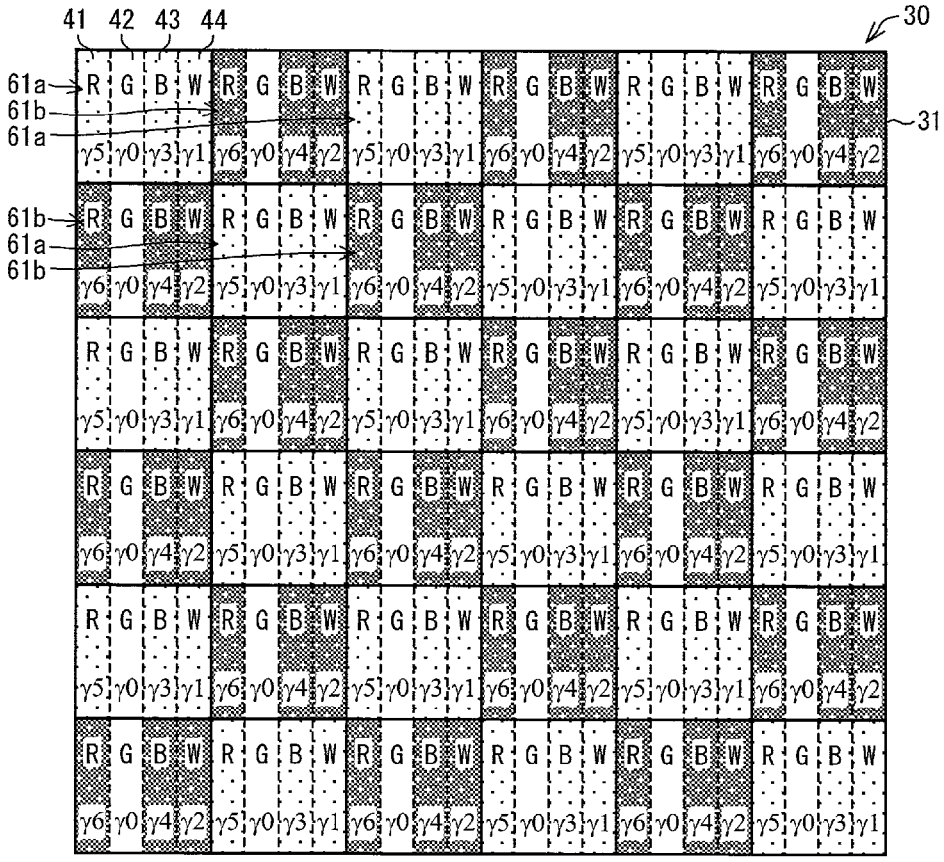
FIG. 10 illustrates a display region of another embodiment of the display device according to the one aspect of the present invention.

Next, with reference to FIGS. 9 and 10, another embodiment of the present invention will be explained in detail. FIG. 9 illustrates a configuration of a display device 2 of the present embodiment. FIG. 10 illustrates a display region in the display device 2 of the present embodiment.

As shown in FIG. 9, the display device 2 of the present embodiment is identical to those of Embodiments 1 through 6, except that the display device 2 includes an R tone characteristic adjusting section 54. Further, in the present embodiment, regarding the method in which the driving section 20 drives the pixels 31, a B setting condition and a W setting condition are different from those of Embodiments 1 through 6. Here, for convenience of explanation, elements having the same functions as those of Embodiments 1 through 6 are given the same reference signs, and explanations thereof are omitted. Mainly explained here will be differences between (i) the present embodiment and (ii) Embodiments 1 through 6.

The R tone characteristic adjusting section 54 converts pieces of R data for their respective R pixels 41 into individual pieces of adjusted R data. Specifically, first, the R tone characteristic adjusting section 54 obtains R setting condition information indicative of a condition (R setting condition) being preset so that the R pixels 41 are associated with corresponding ones of a plurality of gamma curves. After the B tone characteristic adjusting section 53 associates the R pixels 41 with the corresponding ones of the plurality of gamma curves according to the R setting condition information, the B tone characteristic adjusting section 53 converts the pieces of R data for the respective R pixels 41 into the pieces of adjusted R data according to the gamma curves with which the R pixels 41 are associated. Then, the B tone characteristic adjusting section 53 transmits the pieces of adjusted R data to a timing generator 23. Note that the R setting condition information may be stored in a storing section (not shown), for example.

In the present embodiment, each of the plurality of pixels 31 is included in a pixel group 61*a* or a pixel group 61*b*.

(Driving Method)

Next, the following will explain how the driving section 20 carries out driving in the present embodiment. The driving section 20 drives G pixels 42 according to a target gamma curve C0.

Further, a W tone characteristic adjusting section 52, a B tone characteristic adjusting section 53, and the R tone characteristic adjusting section 54 in the driving section 20 respectively associate each W pixel 44, each B pixel 43, and each R pixel 41 with gamma curves according to a W setting condition, a B setting condition, and the R setting condition. The W tone characteristic adjusting section 52 associates each W pixel 44 with one of two gamma curves, the gamma curves C1 and C2. The B tone characteristic adjusting section 53 associates each B pixel 43 with one of two gamma curves, the gamma curves C3 and C4. The R tone characteristic adjusting section 54 associates each R pixel 41 with one of two gamma curves, a gamma curve C5 having a gamma characteristic γ5 and a gamma curve C6 having a gamma characteristic γ6.

More specifically, the driving section 20 drives a W pixel 44, a B pixel 43, and an R pixel 41 constituting a pixel 31 in the pixel group 61*a* according to the gamma curves C1, C3, and C5, respectively. Further, the driving section 20 drives a W pixel 44, a B pixel 43, and an R pixel 41 constituting a pixel 31 in the pixel group 61*b* according to the gamma curves C2, C4, and C6, respectively.

According to the above configuration, the driving section 20 drives all the W pixels 44 by the halftone gray scale method according to the two gamma curves C1 and C2 having different gamma characteristics γ1 and γ2. This makes it possible to further improve the effect that the gamma characteristics of the W pixels 44 compensate for each other, thereby further improving the viewing angle.

Further, the driving section 20 drives all the B pixels 43 by the halftone gray scale method according to the two gamma curves C3 and C4 having different gamma characteristics γ3 and γ4. Furthermore, the driving section 20 drives all the R pixels 41 by the halftone gray scale method according to the two gamma curves C5 and C6 having different gamma characteristics γ5 and γ6. This makes it possible to further improve the effect that the gamma characteristics of the B pixels 43 compensate for each other, thereby reducing the possibility that an image displayed on the display panel 10 is seen to be bluish when viewed at an angle.

The present embodiment has explained, as an example, the configuration in which the driving section 20 includes the R tone characteristic adjusting section 54, and the driving section 20 drives, in addition to the B pixels 43 and the W pixels 44, the R pixels 41 by the halftone gray scale method. However, the present invention is not limited to this. Alternatively, for example, such a configuration may be employed in which the driving section 20 includes a G tone characteristic adjusting section (not shown) in place of the R tone characteristic adjusting section 54, and the driving section 20 drives, in addition to the B pixels 43 and the W pixels 44, the G pixels 42 by the halftone gray scale method.

In a case where the display panel 10 is a liquid crystal panel including, particularly, liquid crystal molecules aligned according to the VA (Vertical Alignment) method, driving (i) the B pixels 43 and the R pixels 41 or (ii) the B pixels 43 and the G pixels 42 in addition to the W pixels 44 by the halftone gray scale method makes it possible to improve a viewing angle characteristic for (i) blue and red components or (ii) blue and green components of color components of an image displayed on the display panel 10, thereby reducing the possibility that the image is seen to be bluish.

[Embodiment 8]

Figure 11:
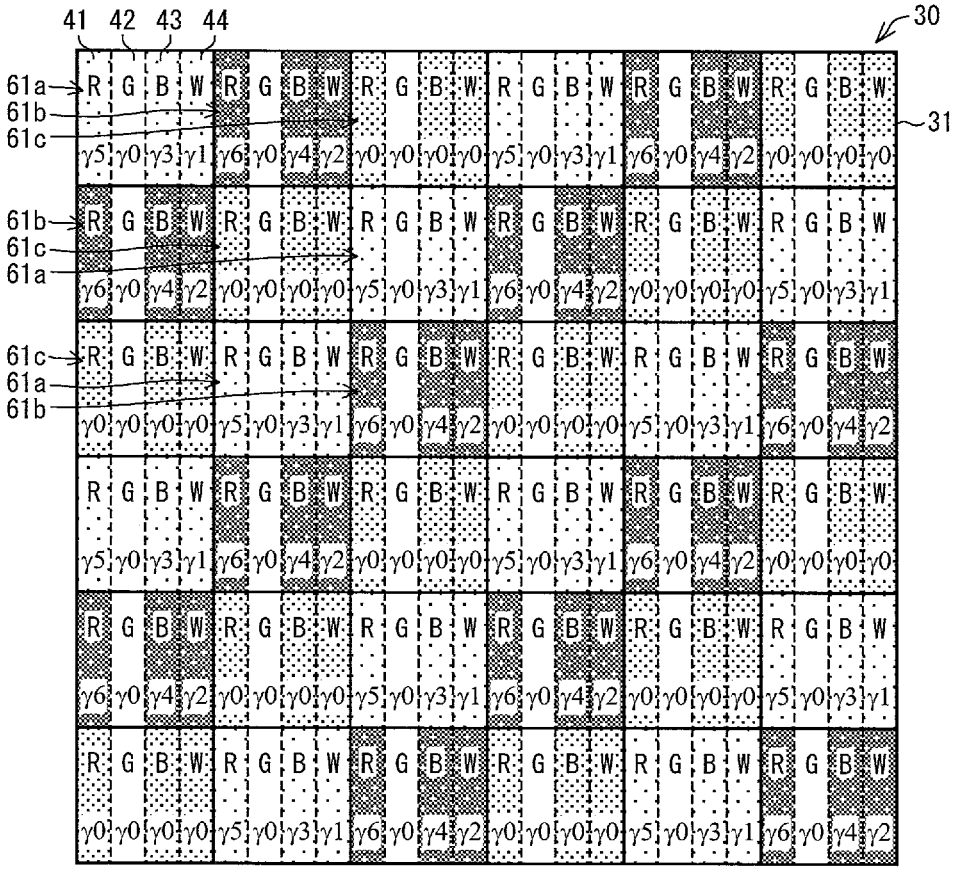
FIG. 11 illustrates a display region of another embodiment of the display device according to the one aspect of the present invention.

Next, with reference to FIG. 11, another embodiment of the present invention will be explained in detail. FIG. 11 illustrates a display region of a display device 2 of the present embodiment.

Regarding the method in which the driving section 20 drives the pixels 31, the display device 2 of the present embodiment is different from those of Embodiments 1 through 7 in the B setting condition, the W setting condition, and the R setting condition. Here, for convenience of explanation, elements having the same functions as those of Embodiments 1 through 7 are given the same reference signs, and explanations thereof are omitted. Mainly explained here will be differences between (i) the present embodiment and (ii) Embodiments 1 through 7.

In the present embodiment, each of a plurality of pixels 31 is included in a pixel group 61*a*, a pixel group 61*b*, or a pixel group 31*c*.

(Driving Method)

The driving section 20 drives G pixels 42 according to a target gamma curve C0 having a target gamma characteristic γ0.

Further, the driving section 20 causes a W tone characteristic adjusting section 52 to associate each W pixel 44 with a corresponding one of three gamma curves, the gamma curves included in the above-described first and second gamma curve groups and the target gamma curve C0, according to a W setting condition. The driving section 20 causes a B tone characteristic adjusting section 53 to associate each B pixel 43 with a corresponding one of the three gamma curves according to a B setting condition. The driving section 20 causes an R tone characteristic adjusting section 54 to associate each R pixel 41 with a corresponding one of the three gamma curves according to an R setting condition. Then, the driving section 20 carries out driving according to the gamma curves thus associated.

The driving section 20 respectively drives a W pixel 44, a B pixel 43, and an R pixel 41 of each pixel 31 in the pixel group 61*a* according to a gamma curve C1, a gamma curve C3, and a gamma curve C5 in the first gamma curve group. Further, the driving section 20 respectively drives a W pixel 44, a B pixel 43, and an R pixel 41 of each pixel 31 in the pixel group 61*b* according to a gamma curve C2, a gamma curve C4, and a gamma curve C6 in the second gamma curve group. Furthermore, the driving section 20 drives a W pixel 44, a B pixel 43, and an R pixel 41 of each pixel 31 in the pixel group 31*c* according to the target gamma curve C0.

According to the above configuration, the driving section 20 respectively drives the W pixels 44, the B pixels 43, and the R pixels 41 according to the three gamma curves having different gamma characteristics.

This makes it possible to further improve the effect that the gamma characteristics of the W pixels 44 compensate for each other, the gamma characteristics of the B pixels 43 compensate for each other, and the gamma characteristics of the R pixels 41 compensate for each other, thereby further improving the viewing angle. Further, it is possible to reduce the possibility that an image displayed on the display panel 10 is seen to be bluish when viewed at an angle.

The present embodiment has explained, as an example, the configuration in which the driving section 20 drives the B pixel 43 and the W pixel 44 of the pixel 31 in the pixel group 31*c* according to the target gamma curve C0. However, the present invention is not limited to this.

Alternatively, for example, such a configuration may be employed in which the driving section 20 drives the B pixel 43 and the W pixel 44 of the pixel 31 in the pixel group 31*c* according to a gamma curve C' in a third gamma curve group having a third gamma characteristic being different from the first and second gamma characteristics. Note that the gamma curve C' may be substantially equal to the target gamma curve C0.

The present embodiment has explained the configuration in which the driving section 20 drives each B pixel 43 according to one of the three gamma curves and drives each W pixel 44 according to one of the three gamma curves. However, the present invention is not limited to this configuration. Alternatively, such a configuration may be employed in which the driving section 20 drives each B pixel 43 according to one of four or more gamma curves and drives each W pixel 44 according to one of the four or more gamma curves.

[Embodiment 9]

Figure 12:
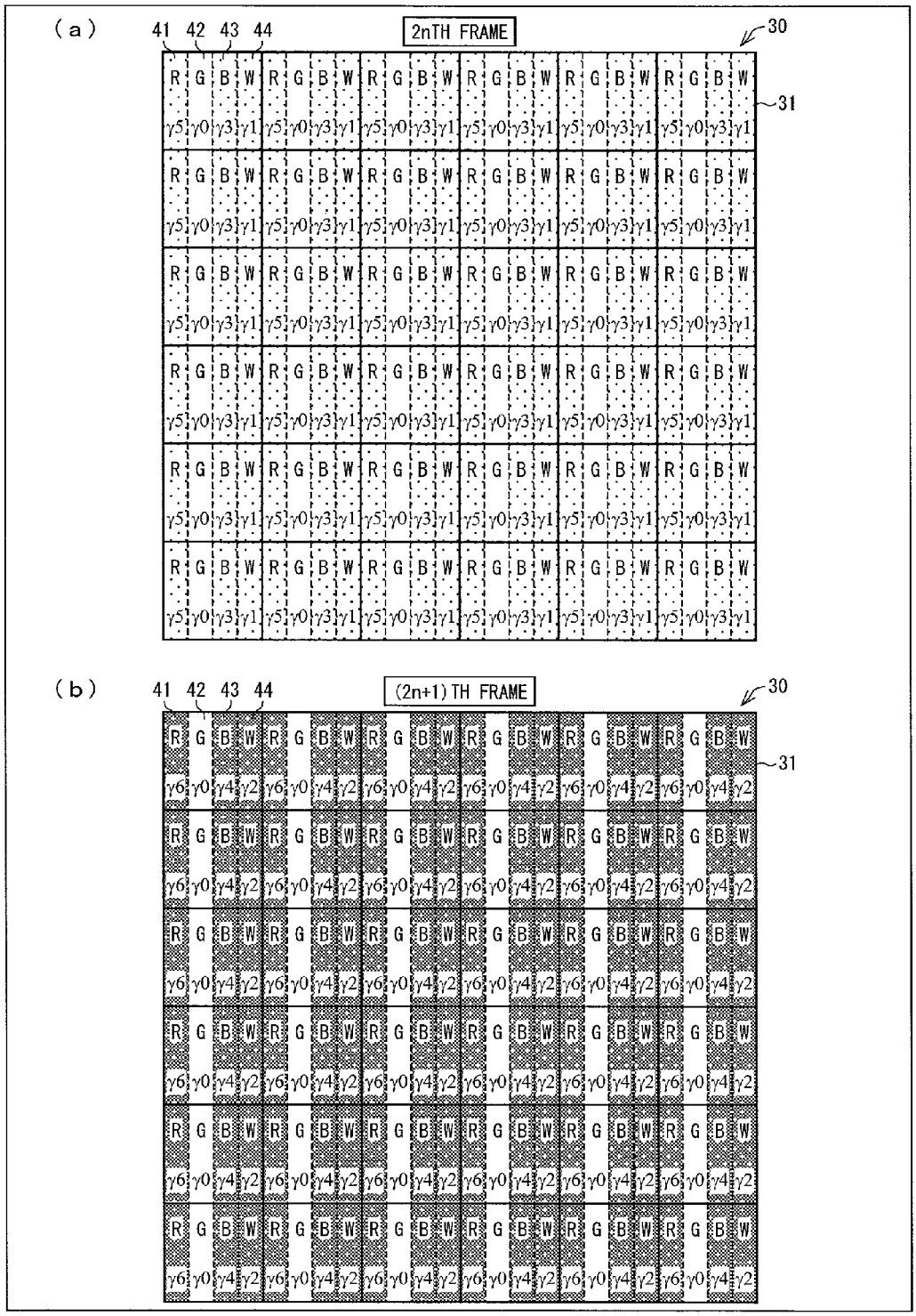
FIG. 12 illustrates a display region of another embodiment of the display device according to the one aspect of the present invention.

Next, with reference to (a) and (b) of FIG. 12, another embodiment of the present invention will be described in detail. (a) and (b) of FIG. 12 illustrate a display region of a display device 2 of the present embodiment. (a) of FIG. 12 illustrates a display region 30 observed in a 2n frame (n is a natural number), and (b) of FIG. 12 illustrates the display region 30 observed in a 2n+1 frame.

Regarding the method in which the driving section 20 drives the pixels 31, the display device 2 of the present embodiment is different from those of Embodiments 1 through 8 in the B setting condition, the W setting condition, and the R setting condition. Here, for convenience of explanation, elements having the same functions as those of Embodiments 1 through 8 are given the same reference signs, and explanations thereof are omitted. Mainly explained here will be differences between (i) the present embodiment and (ii) Embodiments 1 and 2.

The driving section 20 drives G pixels 42 according to a target gamma curve C0 having a target gamma characteristic γ0.

Further, the driving section 20 causes a W tone characteristic adjusting section 52 to associate, in each frame, each W pixel 44 with one of two gamma curves, the gamma curves included in the above-described first and second gamma curve groups, according to a W setting condition. The driving section 20 causes a B tone characteristic adjusting section 53 to associate, in each frame, each B pixel 43 with one of the two gamma curves according to a B setting condition. The driving section 20 causes an R tone characteristic adjusting section 54 to associate, in each frame, each R pixel 41 with one of the two gamma curves according to an R setting condition. Then, the driving section 20 carries out driving according to the gamma curves thus associated.

The driving section 20 respectively drives each W pixel 44, each B pixel 43, and each R pixel 41 according to a gamma curve C1, a gamma curve C3, and a gamma curve C5 in the first gamma curve group in the 2n frame (a frame which is immediately before a certain frame). Further, the driving section 20 respectively drives each W pixel 44, each B pixel 43, and each R pixel 41 according to a gamma curve C2, a gamma curve C4, and a gamma curve C6 in the second gamma curve group in the 2n+1 frame (the certain frame).

Namely, the driving section 20 drives all the R pixels 41 by the halftone gray scale method with use of one of the gamma curves included in the two different gamma curve groups, the one of the gamma curves being selected in each frame. Further, the driving section 20 drives all the B pixels 43 by the halftone gray scale method with use of one of the gamma curves included in the two different gamma curve groups, the one of the gamma curves being selected in each frame. Furthermore, the driving section 20 drives all the W pixels 44 by the halftone gray scale method with use of one of the gamma curves included in the two different gamma curve groups, the one of the gamma curves being selected in each frame.

With the above configuration, each W pixel 44 is driven according to one of the two different gamma curves C1 and C2 selected in each frame, the selection being made so that the gamma curves C1 and C2 alternate with each other. This brings about a viewing angle compensation effect along a time axis. Consequently, it is possible to provide better visibility when the display panel 10 is viewed at an angle and to display an image smoothly. Further, it is possible to prevent impairment in a visually-sensed resolution.

Furthermore, with the above configuration, each B pixel 43 is driven according to one of the two different gamma curves C3 and C4 selected in each frame, the selection being made so that the gamma curves C3 and C4 alternate with each other. Further, each R pixel 41 is driven according to one of the two different gamma curves C5 and C6 selected in each frame, the selection being made so that the gamma curves C5 and C6 alternate with each other. This brings about a viewing angle compensation effect along a time axis. Consequently, it is possible to reduce the possibility that an image displayed on the display panel 10 is seen to be bluish when viewed at an angle.

[Embodiment 10]

Figure 13:
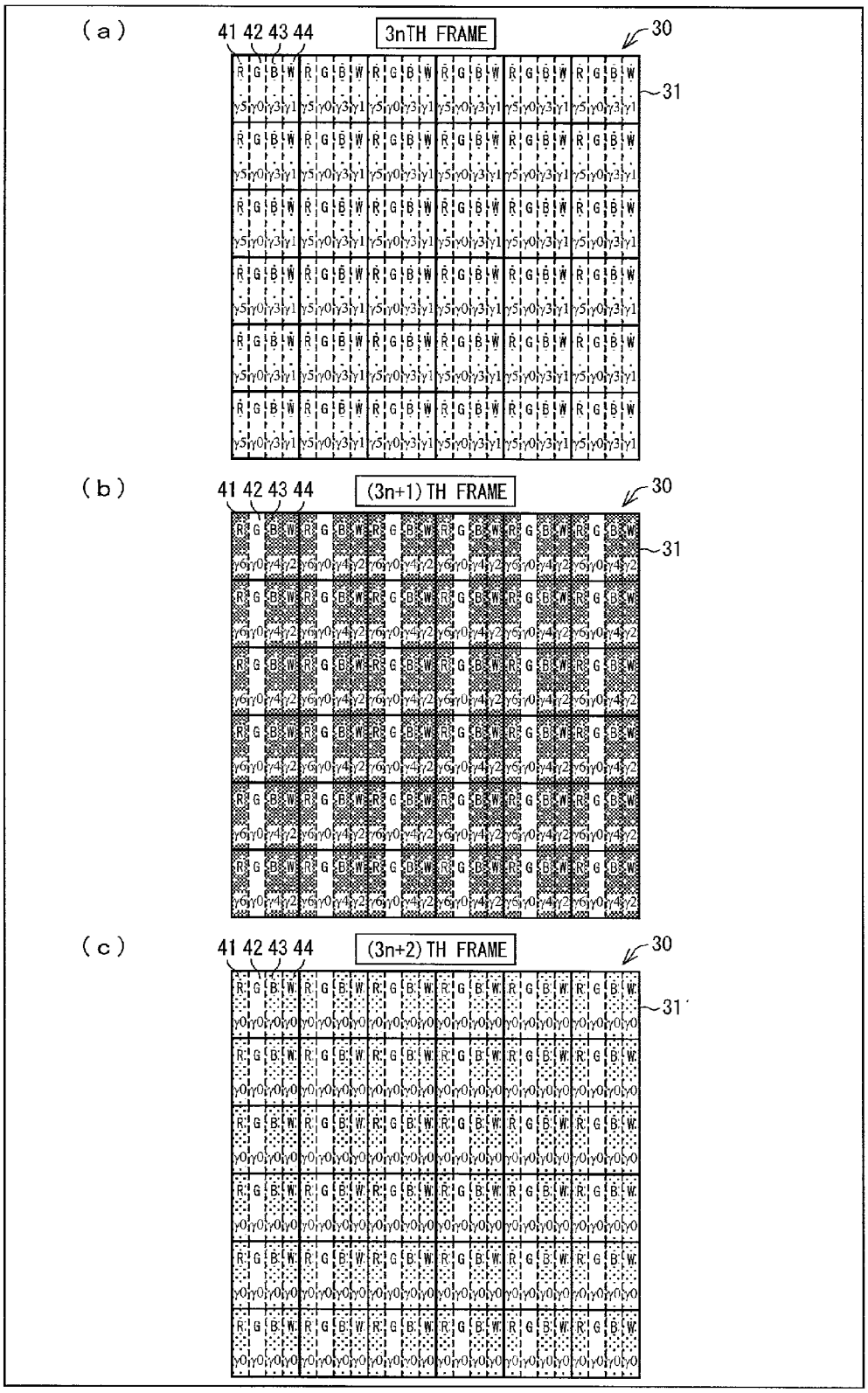
FIG. 13 illustrates a display region of another embodiment of the display device according to the one aspect of the present invention.

Next, with reference to (a) through (c) of FIG. 13, another embodiment of the present invention will be described in detail. (a) through (c) of FIG. 13 illustrate a display region of a display device 2 of the present embodiment. (a) of FIG. 13 illustrates a display region 30 observed in a 3n frame, (b) of FIG. 13 illustrates the display region 30 observed in a 3n+1 frame, and (c) of FIG. 13 illustrates the display region 30 observed in a 3n+2 frame.

Regarding the method in which the driving section 20 drives the pixels 31, the display device 2 of the present embodiment is different from those of Embodiments 1 through 9 in the B setting condition, the W setting condition, and the R setting condition. Here, for convenience of explanation, elements having the same functions as those of Embodiments 1 through 9 are given the same reference signs, and explanations thereof are omitted. Mainly explained here will be differences between (i) the present embodiment and (ii) Embodiments 1 through 3.

The driving section 20 drives G pixels 42 according to a target gamma curve C0 having a target gamma characteristic γ0.

Further, the driving section 20 causes a W tone characteristic adjusting section 52 to associate, in each frame, each W pixel 44 with one of three gamma curves, the gamma curves included in the above-described first and second gamma curve groups and the target gamma curve C0, according to a W setting condition. The driving section 20 causes a B tone characteristic adjusting section 53 to associate, in each frame, each B pixel 43 with one of the three gamma curves according to a B setting condition. The driving section 20 causes an R tone characteristic adjusting section 54 to associate, in each frame, each R pixel 41 with one of the three gamma curves according to an R setting condition. Then, the driving section 20 carries out driving according to the gamma curves thus associated.

The driving section 20 respectively drives each W pixel 44, each B pixel 43, and each R pixels 41 according to a gamma curve C1, a gamma curve C3, and a gamma curve C5 in the first gamma curve group in the 3n frame. Further, the driving section 20 respectively drives each W pixel 44, each B pixel 43, and each R pixel 41 according to a gamma curve C2, a gamma curve C4, and a gamma curve C6 in the second gamma curve group in the 3n+1 frame. Furthermore, the driving section 20 drives each W pixel 44, each B pixels 43, and each R pixel 41 according to the target gamma curve C0 in the 3n+2 frame.

Namely, the driving section 20 drives all the R pixels 41 by the halftone gray scale method according to one of the three gamma curves, the gamma curves included in the two different gamma curve groups and the target gamma curve C0, the one of the three gamma curves being selected in each frame. Further, the driving section 20 drives all the B pixels 43 by the halftone gray scale method according to one of the three gamma curves, the one of the three gamma curves being selected in each frame. Furthermore, the driving section 20 drives all the W pixels 44 by the halftone gray scale method according to one of the three gamma curves, the one of the three gamma curves being selected in each frame. Note that the present invention is not limited to this configuration. Alternatively, the driving section 20 may carry out the driving by the halftone gray scale method using three different gamma curve groups and the target gamma curve C0 being selected for the pixels in each frame. Alternatively, the driving section 20 may carry out the driving by the halftone gray scale method using four or more different gamma curve groups being selected for the pixels in each frame.

With the above configuration, each W pixel 44 is driven according to one of the three different gamma curves selected in each frame, the selection being made so that the gamma curves are used one after another repeatedly. This brings about a viewing angle compensation effect along a time axis. Consequently, it is possible to provide better visibility when the display panel 10 is viewed at an angle and to display an image smoothly. Further, it is possible to prevent impairment in a visually-sensed resolution.

Furthermore, with the above configuration, each B pixel 43 is driven according to one of the two different gamma curves C3 and C4 selected in each frame, the selection being made so that the gamma curves C3 and C4 alternate with each other. Further, each R pixel 41 is driven according to one of the two different gamma curves C5 and C6 selected in each frame, the selection being made so that the gamma curves C5 and C6 alternate with each other. This brings about a viewing angle compensation effect along a time axis. Consequently, it is possible to reduce the possibility that an image displayed on the display panel 10 is seen to be bluish when viewed at an angle.

Instead of the target gamma curve C0, the driving section 20 may carry out the driving according to a gamma curve C', which is included in a third gamma curve group having a third gamma characteristic being different from the first and second gamma characteristics. The gamma curve C' may be substantially equal to the target gamma curve C0.

[Embodiment 11]

Figure 14:
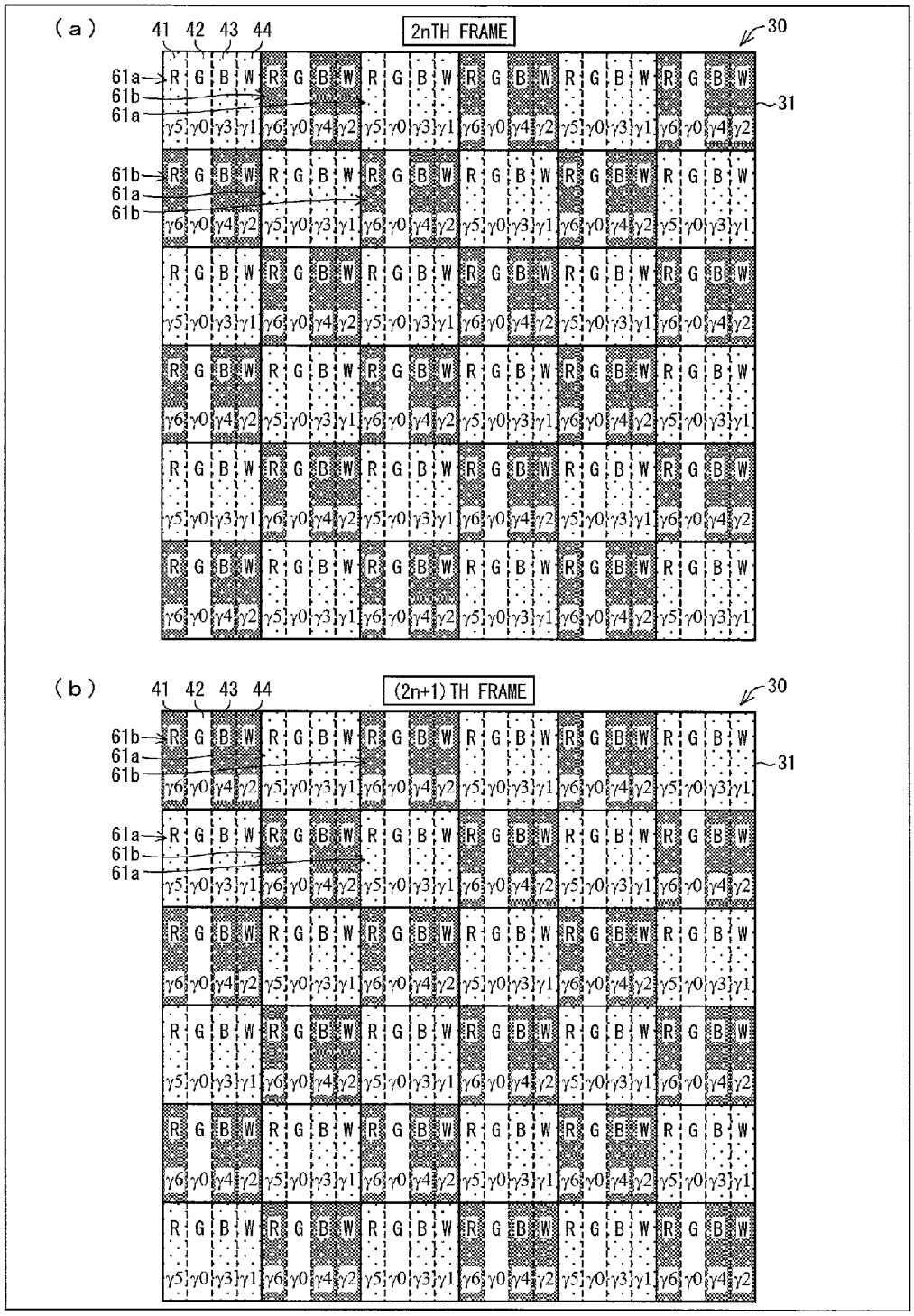
FIG. 14 illustrates a display region of another embodiment of the display device according to the one aspect of the present invention.

Next, with reference to (a) and (b) of FIG. 14, another embodiment of the present invention will be described in detail. (a) and (b) of FIG. 14 illustrate a display region of a display device 2 of the present embodiment. (a) of FIG. 14 illustrates a display region 30 observed in a 2n frame, and (b) of FIG. 14 illustrates the display region 30 observed in a 2n+1 frame.

Regarding the method in which the driving section 20 drives the pixels 31, the display device 2 of the present embodiment is different from those of Embodiments 1 through 10 in the B setting condition, the W setting condition, and the R setting condition. Here, for convenience of explanation, elements having the same functions as those of Embodiments 1 through 10 are given the same reference signs, and explanations thereof are omitted. Mainly explained here will be differences between (i) the present embodiment and (ii) Embodiments 1 through 3.

In the present embodiment, each of a plurality of pixels 31 is included in a pixel group 61*a* or a pixel group 61*b*.

The driving section 20 drives G pixels 42 according to a target gamma curve C0 having a target gamma characteristic γ0.

Further, the driving section 20 causes a W tone characteristic adjusting section 52 to associate, in each frame, each W pixel 44 with a corresponding one of two gamma curves, the gamma curves included in the above-described first and second gamma curve groups, according to a W setting condition. The driving section 20 causes a B tone characteristic adjusting section 53 to associate, in each frame, each B pixel 43 with a corresponding one of the two gamma curves according to a B setting condition. The driving section 20 causes an R tone characteristic adjusting section 54 to associate, in each frame, each R pixel 41 with a corresponding one of the two gamma curves according to an R setting condition. Then, the driving section 20 carries out driving according to the gamma curves thus associated.

In the 2n frame, the driving section 20 respectively drives a W pixel 44, a B pixel 43, and an R pixel 41 of each pixel 31 in the pixel group 61*a* according to a gamma curve C1, a gamma curve C3, and a gamma curve C5 in the first gamma curve group, and respectively drives a W pixel 44, a B pixel 43, and an R pixel 41 of each pixel 31 in the pixel group 61*b* according to a gamma curve C2, a gamma curve C4, and a gamma curve C6 in the second gamma curve group.

Further, in the 2n+1 frame, the driving section 20 respectively drives the W pixel 44, the B pixel 43, and the R pixel 41 of each pixel 31 in the pixel group 61*a* according to the gamma curve C2, the gamma curve C4, and the gamma curve C6 in the second gamma curve group, and respectively drives the W pixel 44, the B pixel 43, and the R pixel 41 of each pixel 31 in the pixel group 61*b* according to the gamma curve C1, the gamma curve C3, and the gamma curve C5 in the first gamma curve group.

Namely, the driving section 20 drives all the R pixels 41 by the halftone gray scale method with use of corresponding ones of the two different gamma curve groups being selected (i) depending on positions where the R pixels 41 are located and (ii) in each frame. Further, the driving section 20 drives all the B pixels 43 by the halftone gray scale method with use of corresponding ones of the two different gamma curve groups being selected (i) depending on positions where the B pixels 43 are located and (ii) in each frame. Furthermore, the driving section 20 drives all the W pixels 44 by the halftone gray scale method with use of corresponding ones of the two different gamma curve groups being selected (i) depending on positions where the W pixels 44 are located and (ii) in each frame.

With this configuration, it is possible to further improve the effect that the gamma characteristics of the W pixels 44 compensate for each other in one frame. This makes it possible to further improve the viewing angle and also to bring about a viewing angle compensation effect along a time axis. Consequently, it is possible to provide better visibility when the display panel 10 is viewed at an angle and to display an image more smoothly. Further, it is possible to prevent impairment in a visually-sensed resolution.

Furthermore, with this configuration, it is possible to further improve the effect that the gamma characteristics of R pixels 41 compensate for each other and the gamma characteristics of the B pixels 43 compensate for each other in one frame. This brings about a viewing angle compensation effect along a time axis, thereby reducing the possibility that an image displayed on the display panel 10 is seen to be bluish when viewed at an angle.

[Embodiment 12]

Figure 15:
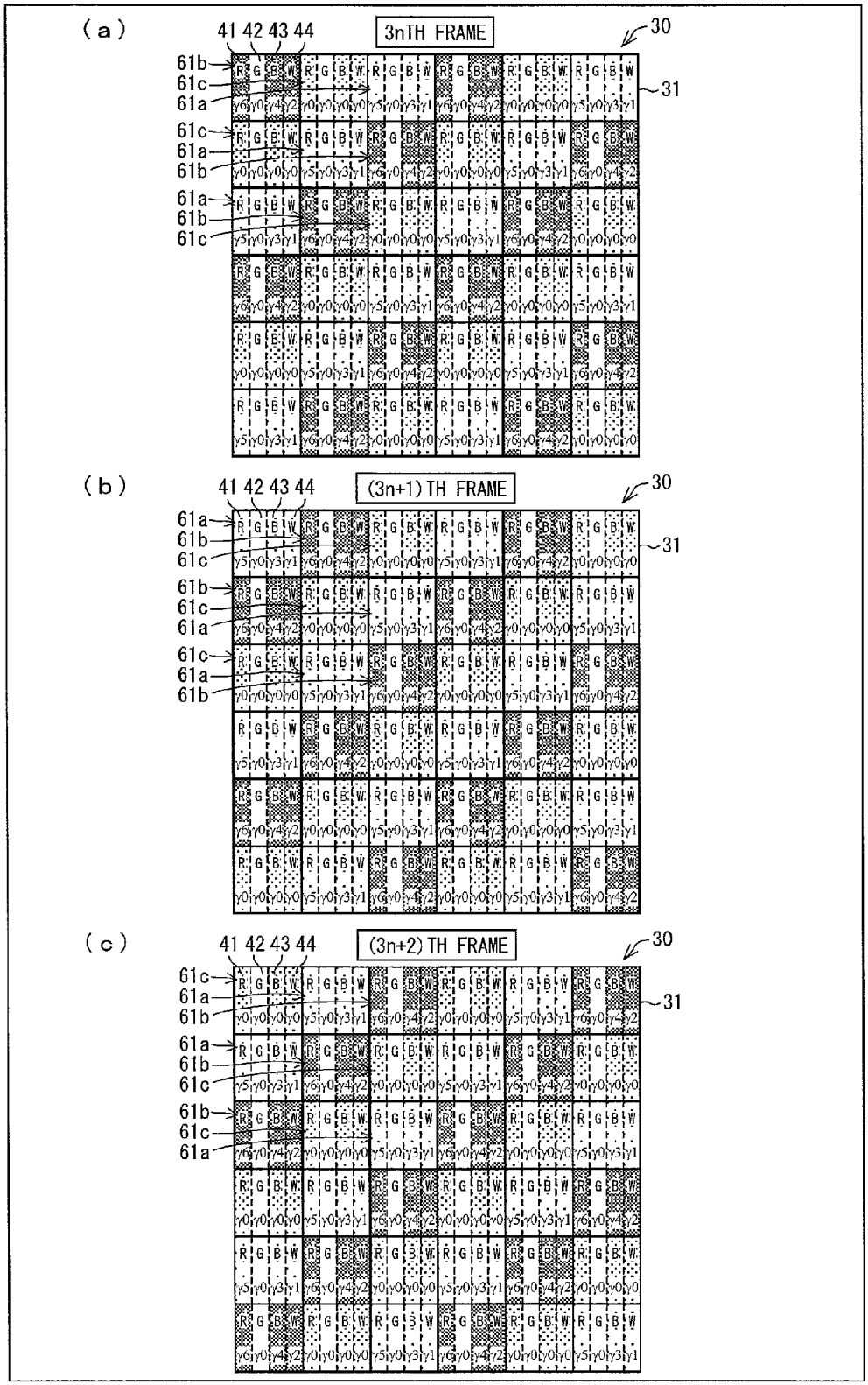
FIG. 15 illustrates a display region of another embodiment of the display device according to the one aspect of the present invention.

Next, with reference to (a) through (c) of FIG. 15, another embodiment of the present invention will be described in detail. (a) through (c) of FIG. 15 illustrate a display region of a display device 2 of the present embodiment. (a) of FIG. 15 illustrates a display region 30 observed in a 3n frame, (b) of FIG. 15 illustrates the display region 30 observed in a 3n+1 frame, and (c) of FIG. 15 illustrates the display region 30 observed in a 3n+2 frame.

The display device 2 of the present embodiment is different from those of Embodiments 1 through 11 in the B setting condition, the W setting condition, and the R setting condition. Therefore, according to the present embodiment, the display device 2 drives pixels 31 in a different manner from those of Embodiments 1 through 11. Here, for convenience of explanation, elements having the same functions as those of Embodiments 1 through 10 are given the same reference signs, and explanations thereof are omitted. Mainly explained here will be differences between (i) the present embodiment and (ii) Embodiments 1 through 3.

In the present embodiment, each of a plurality of pixels 31 is included in a pixel group 61*a*, a pixel group 61*b*, or a pixel group 61*c*.

The driving section 20 drives G pixels 42 according to a target gamma curve C0 having a target gamma characteristic γ0.

Further, the driving section 20 causes a tone characteristic adjusting section 52 to associate, in each of three frames, each W pixel 44 with a corresponding one of three gamma curves, the gamma curves included in the above-described first and second gamma curve groups and the target gamma curve C0, according to a W setting condition. The driving section 20 causes a tone characteristic adjusting section 53 to associate, in each of the three frames, each B pixel 43 with a corresponding one of the three gamma curves according to a B setting condition. The driving section 20 causes a tone characteristic adjusting section 54 to associate, in each of the three frames, each R pixel 41 with a corresponding one of the three gamma curves according to an R setting condition. Then, the driving section 20 carries out driving according to the gamma curves thus associated.

In the 3n frame, the driving section 20 carries out the following operation: The driving section 20 respectively drives a W pixel 44, a B pixel 43, and an R pixel 41 of each pixel 31 in the pixel group 61*a* according to a gamma curve C2, a gamma curve C4, and a gamma curve C6 in the second gamma curve group. Further, the driving section 20 drives a W pixel 44, a B pixel 43, and an R pixel 41 of each pixel 31 in the pixel group 61*b* according to the target gamma curve C0. Furthermore, the driving section 20 respectively drives a W pixel 44, a B pixel 43, and an R pixel 41 of each pixel 31 in the pixel group 61*c* according to a gamma curve C1, a gamma curve C3, and a gamma curve C5 in the first gamma curve group.

Next, in the 3n+1 frame, the driving section 20 carries out the following operation: The driving section 20 respectively drives the W pixel 44, the B pixel 43, and the R pixel 41 of each pixel 31 in the pixel group 61*a* according to the gamma curve C1, the gamma curve C3, and the gamma curve C5 in the first gamma curve group. Further, the driving section 20 respectively drives the W pixel 44, the B pixel 43, and the R pixel 41 of each pixel 31 in the pixel group 61*b* according to the gamma curve C2, the gamma curve C4, and the gamma curve C6 in the second gamma curve group. Furthermore, the driving section 20 drives the W pixel 44, the B pixel 43, and the R pixel 41 of each pixel 31 in the pixel group 61*c* according to the target gamma curve C0.

Next, in the 3n+2 frame, the driving section 20 carries out the following operation: The driving section 20 drives the W pixel 44, the B pixel 43, and the R pixel 41 of each pixel 31 in the pixel group 61*a* according to the target gamma curve C0. Further, the driving section 20 respectively drives the W pixel 44, the B pixel 43, and the R pixel 41 of each pixel 31 in the pixel group 61*b* according to the gamma curve C1, the gamma curve C3, and the gamma curve C5 in the first gamma curve group. Furthermore, the driving section 20 respectively drives the W pixel 44, the B pixel 43, and the R pixel 41 of each pixel 31 in the pixel group 61*c* according to the gamma curve C2, the gamma curve C4, and the gamma curve C6 in the second gamma curve group.

Namely, the driving section 20 drives all the R pixels 41 by the halftone gray scale method with use of corresponding ones of the three gamma curves, the two gamma curves in the two different gamma curve groups and the target gamma curve C0, the corresponding ones of the three gamma curves being selected (i) depending on positions where the R pixels 41 are located and (ii) in each frame. Further, the driving section 20 drives all the B pixels 43 by the halftone gray scale method with use of corresponding ones of the three gamma curves being selected (i) depending on positions where the B pixels 43 are located and (ii) in each frame. Furthermore, the driving section 20 drives all the W pixels 44 by the halftone gray scale method with use of corresponding ones of the three gamma curves being selected (i) depending on positions where the W pixels 44 are located and (ii) in each frame.

With this configuration, it is possible to further improve the effect that the gamma characteristics of the W pixels 44 compensate for each other in one frame. This makes it possible to further improve the viewing angle and also to bring about a viewing angle compensation effect along a time axis. Consequently, it is possible to provide better visibility when the display panel 10 is viewed at an angle and to display an image more smoothly. Further, it is possible to prevent impairment in a visually-sensed resolution.

Furthermore, with this configuration, it is possible to further improve the effect that the gamma characteristics of R pixels 41 compensate for each other and the gamma characteristics of the B pixels 43 compensate for each other in one frame. This brings about a viewing angle compensation effect along a time axis, thereby reducing the possibility that an image displayed on the display panel 10 is seen to be bluish when viewed at an angle.

[Embodiment 13]

Figure 16:
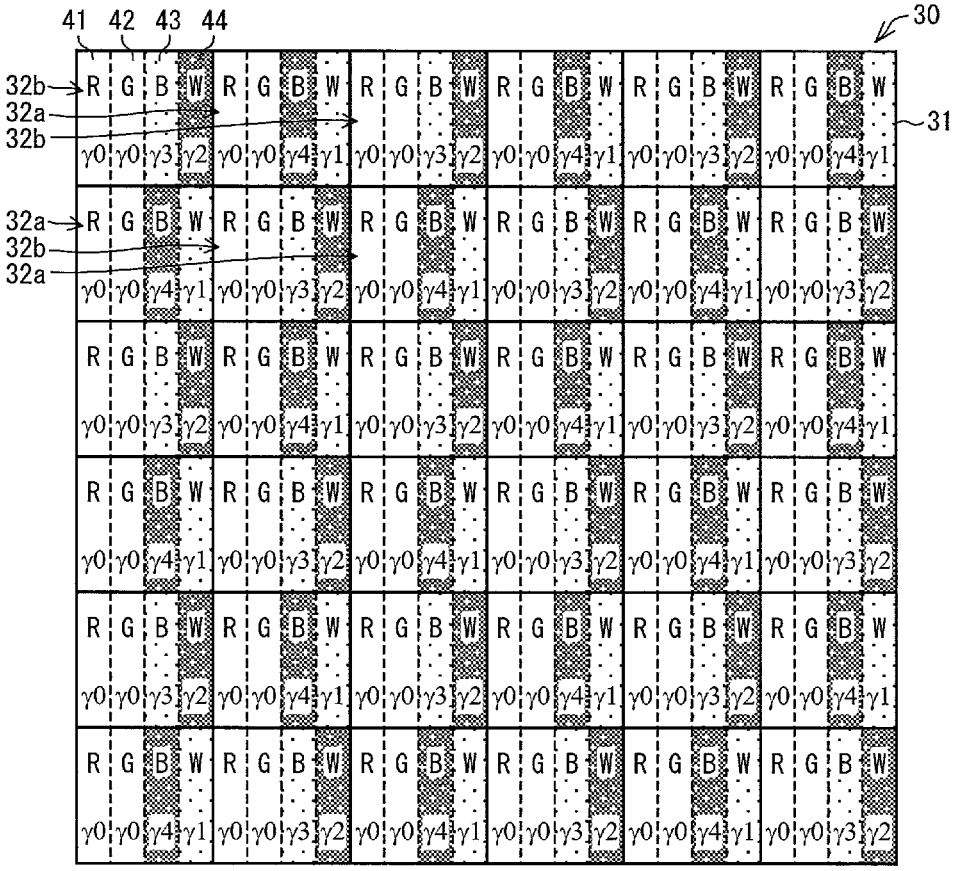
FIG. 16 illustrates a display region of another embodiment of the display device according to the one aspect of the present invention.

The driving section 20 of the present invention may drive a B pixel 43 and a W pixel 44 in one(1) pixel 31 according to respective gamma curves in different gamma curve groups. With reference to FIG. 16, the following explains how the driving section 20 operates in such the case. FIG. 16 illustrates a display region of a display device of the present embodiment.

In the present embodiment, the driving section 20 respectively associates B pixels 43 and W pixels 44 with gamma curves according to a B setting condition and a W setting condition. Note that, in the present embodiment, each of a plurality of pixels 31 is included in a pixel group 32*a* or a pixel group 32*b*.

The driving section 20 drives R pixels 41 and G pixels 42 according to a target gamma curve C0 having a target gamma characteristic γ0.

Further, according to a W setting condition, the driving section 20 causes a W tone characteristic adjusting section 52 to associate a W pixel 44 of each pixel 31 in the pixel group 32*a* with a gamma curve C1 in the above-described first gamma curve group, and to associate a W pixel 44 of each pixel 31 in the pixel group 32*b* with a gamma curve C2 in the above-described second gamma curve group. The driving section 20 drives the W pixels 44 according to the gamma curves thus associated by the W tone characteristic adjusting section 52.

Furthermore, according to a B setting condition, the driving section 20 causes a B tone characteristic adjusting section 53 to associate a B pixel 43 of each pixel 31 in the pixel group 32*a* with a gamma curve C4 in the above-described second gamma curve group, and to associate a B pixel 43 of each pixel 31 in the pixel group 32*b* with a gamma curve C3 in the above-described first gamma curve group. The driving section 20 drives the B pixels 43 according to the gamma curves thus associated by the B tone characteristic adjusting section 53.

The present embodiment has explained, as an example, the configuration in which the B pixel 43 and the W pixel 44 in one pixel 31 are driven according to the respective gamma curves in the different gamma curve groups. However, the present invention is not limited to this. Alternatively, for example, such a configuration may be employed in which the B pixel 43 and the W pixel 44 in one pixel 31 may be driven according to respective gamma curves having different gamma characteristics included in one gamma curve group.

In this case, for example, the first gamma curve group may include the gamma curves C1 and C4, and the second gamma curve group may include the gamma curves C2 and C3. Further, the driving section 20 may respectively associate the B pixels 43 and the W pixels 44 with corresponding gamma curves according to the B setting condition and the W setting condition in the following manner.

According to the W setting condition, the driving section 20 causes the W tone characteristic adjusting section 52 to associate the W pixel 44 of each pixel 31 in the pixel group 32*a* with the gamma curve C1 in the above-described first gamma curve group, and to associate the W pixel 44 of each pixel 31 in the pixel group 32*b* with the gamma curve C1 in the above-described second gamma curve group. The driving section 20 drives the W pixels 44 according to the gamma curves thus associated by the W tone characteristic adjusting section 52.

Furthermore, according to the B setting condition, the driving section 20 causes the B tone characteristic adjusting section 53 to associate the B pixel 43 of each pixel 31 in the pixel group 32*a* with the gamma curve C4 in the above-described first gamma curve group, and to associate the B pixel 43 of each pixel 31 in the pixel group 32*b* with the gamma curve C3 in the above-described second gamma curve group. The driving section 20 drives the B pixels 43 according to the gamma curves thus associated by the B tone characteristic adjusting section 53.

[Embodiment 14]

Figure 17:
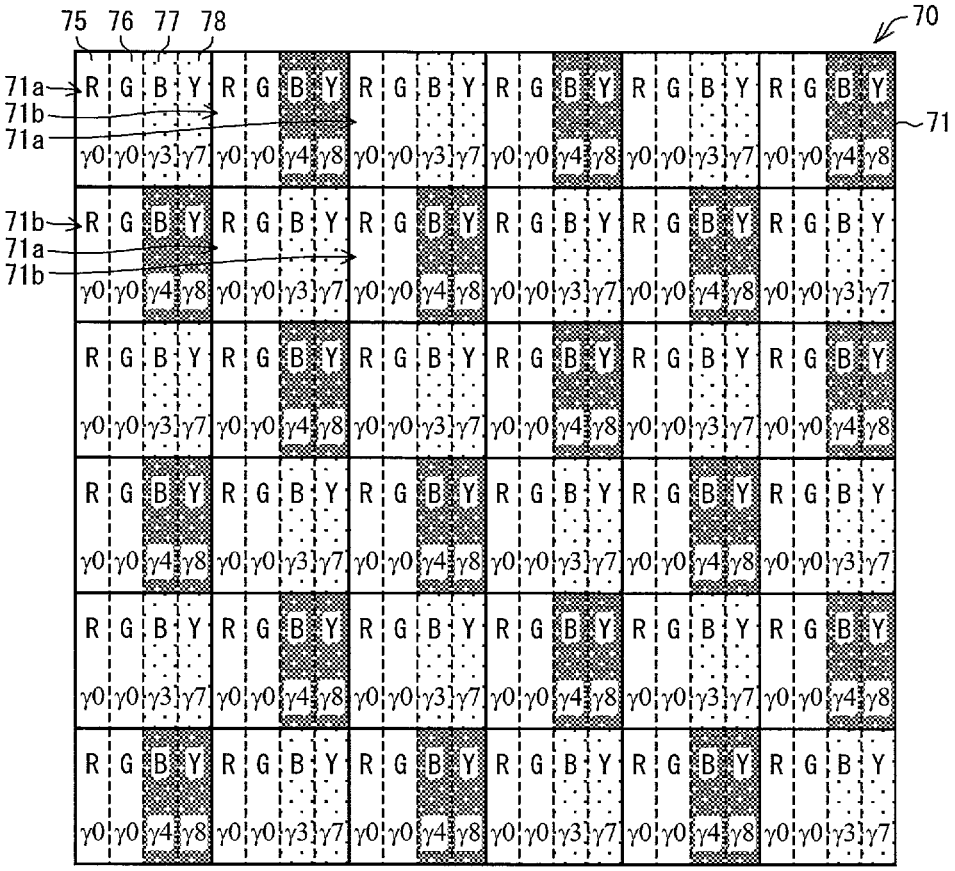
FIG. 17 illustrates a display region of another embodiment of the display device according to the one aspect of the present invention.

The plurality of pixels constituting the display region of the display device of the present invention may include, as a second sub pixel, a Y pixel for displaying yellow. With reference to FIG. 17, the following explains a configuration including the Y pixels as the second sub pixels. FIG. 17 illustrates a display region of a display device including the Y pixels as the second sub pixels.

As shown in FIG. 17, a plurality of pixels 71 constituting a display region 70 includes R pixels 75, G pixels 76, and B pixels 77 as first sub pixels and includes Y pixels 78 as the second sub pixels. In the present embodiment, each of the plurality of pixels 71 is included in a pixel group 71*a* or a pixel group 71*b*.

In the present embodiment, a driving section 20 may include a Y tone characteristic adjusting section (not shown) instead of a W tone characteristic adjusting section 52.

The driving section 20 drives the R pixels 41 and the G pixels 42 according to a target gamma characteristic γ0 having a target gamma curve C0.

Further, according to a B setting condition and a Y setting condition, the driving section 20 carried out the following operation: The driving section 20 causes a B tone characteristic adjusting section 53 to associate a B pixel 77 of each pixel 71 in the pixel group 71*a* with a gamma curve C3 in a first gamma curve group. The driving section 20 causes a Y tone characteristic adjusting section to associate a Y pixel 78 of each pixel 71 in the pixel group 71*a* with a gamma curve C7 in the first gamma curve group. Furthermore, the driving section 20 causes the B tone characteristic adjusting section 53 to associate a B pixel 77 of each pixel 71 in the pixel group 71*b* with a gamma curve C4 in a second gamma curve group. The driving section 20 causes the Y tone characteristic adjusting section to associate a Y pixel 78 of each pixel 71 in the pixel group 71*b* with a gamma curve C8 in the second gamma curve group.

The driving section 20 drives the B pixels 77 and the Y pixels 78 according to the gamma curves thus associated by the B tone characteristic adjusting section 53 and the Y tone characteristic adjusting section.

[Embodiment 15]

Figure 18:
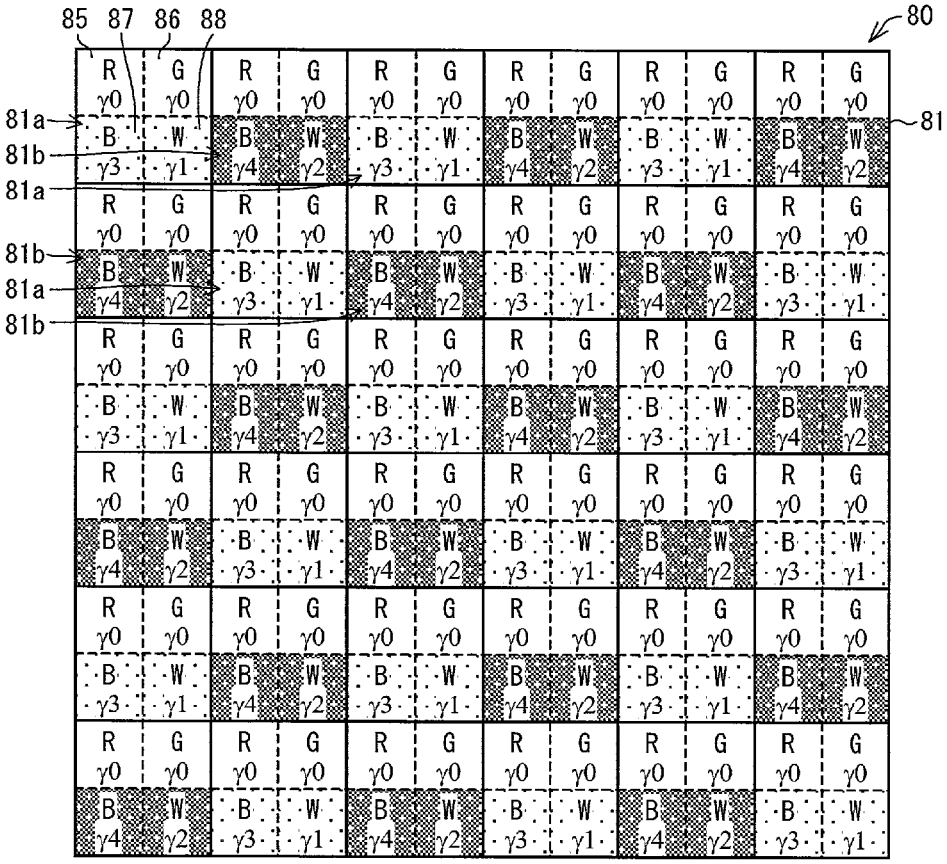
FIG. 18 illustrates a display region of another embodiment of the display device according to the one aspect of the present invention.
Figure 19:
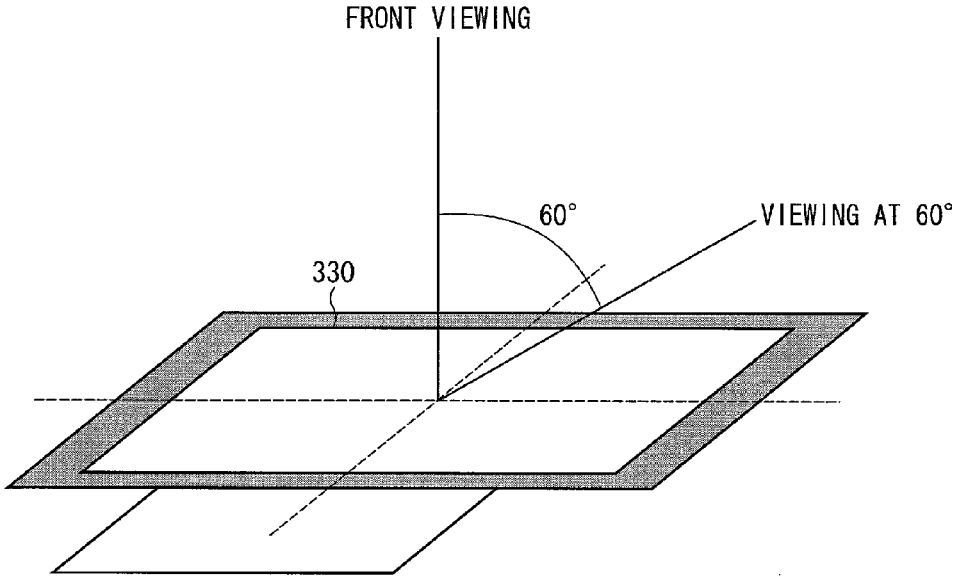
FIG. 19 PRIOR ART
FIG. 19 illustrates a positional relationship between (i) a case where a display region is viewed from the front (front viewing) and (ii) a case where the display region is viewed at a viewing angle of 60° (viewing at 60°).
Figure 20:
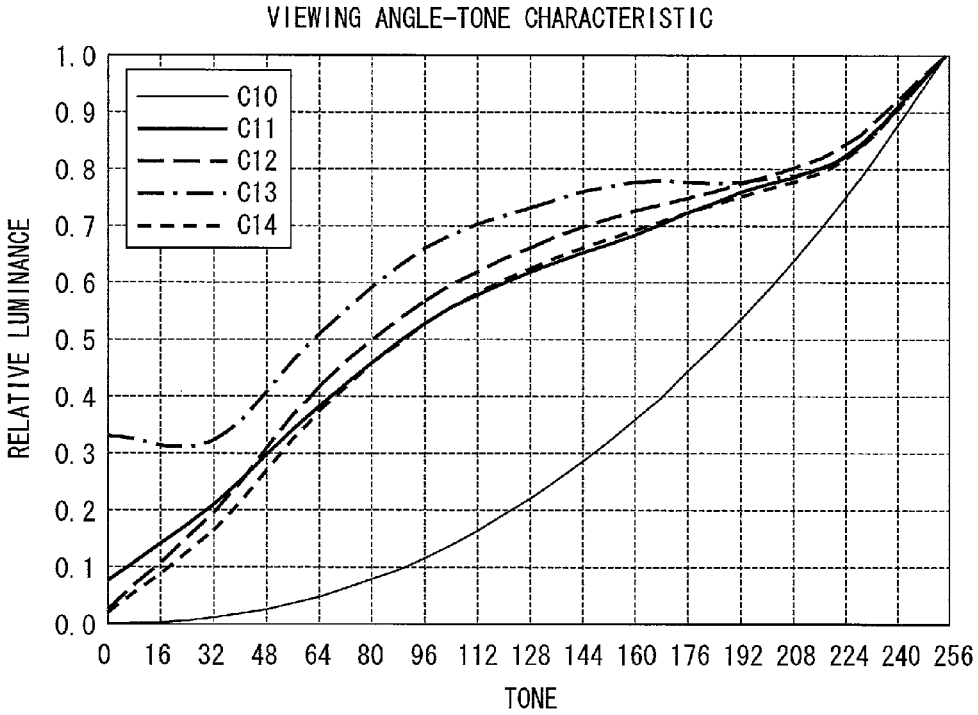
FIG. 20 PRIOR ART
FIG. 20 illustrates tone RGBW characteristics observed when a display region of a conventional display device is viewed at a viewing angle of 60°, the conventional display device being adjusted so that its RGBW tone characteristics observed when the display region is viewed from the front become closer to a gamma curve ($\gamma$=2.2).

Furthermore, the first and second sub pixels in the plurality of pixels constituting the display region in the display device of the present invention may be arranged in a 2×2 matrix. With reference to FIG. 18, the following explains a configuration in which first and second sub pixels are arranged in a 2×2 matrix. FIG. 18 illustrates a display region of a display device including first and second sub pixels arranged in a 2×2 matrix.

As shown in FIG. 18, each of a plurality of pixels 81 constituting a display region 80 includes an R pixel 85, a G pixel 86, a B pixel 87, and a W pixel 88. The pixels 85 through 88 are arranged in a 2×2 matrix. Note that each of the plurality of pixels 81 is included in a pixel group 81*a* or a pixel group 81*b*.

The driving section 20 drives the R pixels 85 and the G pixels 86 according to a target gamma curve C0 having a target gamma characteristic γ0.

Further, according to a B setting condition and a W setting condition, the driving section 20 carries out the following operation: The driving section 20 causes a B tone characteristic adjusting section 53 to associate a B pixel 87 of each pixel 81 in the pixel group 81*a* with a gamma curve C3 in a first gamma curve group. The driving section 20 causes a W tone characteristic adjusting section 52 to associate a W pixel 88 of each pixel 81 in the pixel group 81*a* with a gamma curve C1 in the first gamma curve group. Furthermore, the driving section 20 causes the B tone characteristic adjusting section 53 to associate a B pixel 87 of each pixel 81 in the pixel group 81*b* with a gamma curve C4 in a second gamma curve group. The driving section 20 causes the W tone characteristic adjusting section 52 to associate a W pixel 88 of each pixel 81 in the pixel group 81*b* with a gamma curve C2 in the second gamma curve group.

The driving section 20 drives the B pixels 87 and the W pixels 88 according to the gamma curves thus associated by the B tone characteristic adjusting section 53 and the W tone characteristic adjusting section 52.

Also with the above configuration, it is possible to further improve the effect that the gamma characteristics of the W pixels 44 compensate for each other and the gamma characteristics of the B pixels 43 compensate for each other, thereby further improving the viewing angle. Furthermore, it is possible to reduce the possibility that an image displayed on the display panel 10 is seen to be bluish when viewed at an angle.

In the present embodiment, the driving section 20 may carry out driving according to the above-described method so that (i) the B pixels are driven according to the same gamma curve and the W pixels (or the Y pixels) are driven according to the same gamma curve in all frames or (ii) the B pixels are driven according to different gamma curves and the W pixels (or the Y pixels) are driven according to different gamma curves in different frames. The present embodiment has explained the configuration in which the B pixels are driven according to corresponding ones of two gamma curves and the W pixels (or the Y pixels) are driven according to corresponding ones of the two gamma curves. However, the present invention is not limited to this configuration. Alternatively, the B pixels may be driven according to corresponding ones of three or more gamma curves and the W pixels (or the Y pixels) may be driven according to corresponding ones of the three or more gamma curves.

The present embodiment has explained the configuration in which the plurality of pixels constitute two different pixel groups. However, the present invention is not limited to this configuration. Alternatively, the plurality of pixels may constitute three or more pixel groups.

The present invention is not limited to the description of the embodiments above, but may be altered by a skilled person within the scope of the claims. An embodiment based on a proper combination of technical means disclosed in different embodiments is encompassed in the technical scope of the present invention.

[Additional Remarks]

As described above, a display device according to one aspect of the present invention is a display device including: a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected depending on a position(s) where said at least part of the N-M first sub pixel(s) is/are located, and (ii) at least part of a second sub pixel(s) is/are driven according to one of the first and second gamma curve groups, the one of the first and second gamma curve groups being selected depending on a position(s) where said at least part of the second sub pixel(s) is/are located, the first gamma curve group being different from the common gamma curve, the second gamma curve group being different from the common gamma curve and the first gamma curve group.

According to the above configuration, the M first sub pixel(s) among the N first sub pixels, which are included in each pixel and display different colors, are uniformly driven by the driving means with use of the common gamma curve. This prevents occurrence of the conventional problems, e.g., the problem of failing to display an oblique line that is to be displayed.

Further, the driving means drives at least part of the plurality of pixels so that, in each of said at least part of the plurality of pixels, (i) at least part of an N-M first sub pixel(s) is/are driven according to one of two different gamma curve groups, the one of the two different gamma curve groups being selected depending on a position(s) where said at least part of the N-M first sub pixel(s) is/are located, and (ii) at least part of a second sub pixel(s) is/are driven according to one of the two different gamma curve groups, the one of the two different gamma curve groups being selected depending on a position(s) where said at least part of the second sub pixel(s) is/are located. This allows gamma characteristics of the N-M first sub pixels to compensate for each other and allows gamma characteristics of the second sub pixels to compensate for each other, thereby preventing the color deviation which may occur when the display panel is viewed at an angle. This makes it possible to improve the viewing angle characteristic.

The driving means drives, among the sub pixels included in each pixel, the M first sub pixel(s) according to the common gamma curve uniformly. Further, the driving means drives, among the sub pixels included in each pixel, only the N-M first sub pixel(s) and the second sub pixel(s) according to corresponding ones of the plurality of gamma curves including the two different gamma curves, the corresponding ones of the plurality of gamma curves being respectively selected depending on positions where the N-M first sub pixel(s) and the second sub pixel(s) are located. As compared with a configuration in which all the sub pixels included in each pixel are driven corresponding ones of the plurality of gamma curves including the two different gamma curves, the above configuration allows the driving means to have a simple configuration. This makes it possible to provide a reduction in the circuit scale, a reduction in cost, and a reduction in electric power consumption.

Note that the first gamma curve group includes one or more gamma curves being different from the common gamma curve, and the second gamma curve group includes one or more gamma curves being different from the common gamma curve and the one or more gamma curves included in the first gamma curve group.

The display device according to the one aspect of the present invention is preferably configured such that: the plurality of pixels constitute a plurality of pixel groups being located in different positions, the plurality of pixel groups including a first pixel group and a second pixel group; the driving means drives an N-M first sub pixel(s) and a second sub pixel(s) of a pixel in the first pixel group according to the first gamma curve group; and the driving means drives an N-M first sub pixel(s) and a second sub pixel(s) of a pixel in the second pixel group according to the second gamma curve group.

With the above configuration, the driving means drives an N-M first sub pixel(s) and a second sub pixel(s) of a pixel in one of the plurality of pixel groups being located in different positions according to one of the first and second gamma curve groups being different from each other, and drives an N-M first sub pixel(s) and a second sub pixel(s) of a pixel in another one of the plurality of pixel groups according to one of the first and second gamma curve groups. This makes it possible to improve the effect that the gamma characteristics of the N-M first sub pixels compensate for each other and the gamma characteristics of the second sub pixels compensate for each other, thereby improving the viewing angle characteristic.

Further, the display device according to the one aspect of the present invention is preferably configured such that: the plurality of pixels constitute a plurality of pixel groups being located in different positions, the plurality of pixel groups including a first pixel group and a second pixel group; in a case where the driving means drives an N-M first sub pixel(s) and a second sub pixel(s) of a pixel in the first pixel group according to the first gamma curve group and drives an N-M first sub pixel(s) and a second sub pixel(s) of a pixel in the second pixel group according to the second gamma curve group in a frame immediately before a certain frame, the driving means drives the N-M first sub pixel(s) and the second sub pixel(s) of the pixel in the first pixel group according to the second gamma curve group and drives the N-M first sub pixel(s) and the second sub pixel(s) of the pixel in the second pixel group according to the first gamma curve group in the certain frame; and in a case where the driving means drives an N-M first sub pixel(s) and a second sub pixel(s) of a pixel in the first pixel group according to the second gamma curve group and drives an N-M first sub pixel(s) and a second sub pixel(s) of a pixel in the second pixel group according to the first gamma curve group in a frame immediately before a certain frame, the driving means drives the N-M first sub pixel(s) and the second sub pixel(s) of the pixel in the first pixel group according to the first gamma curve group and drives the N-M first sub pixel(s) and the second sub pixel(s) of the pixel in the second pixel group according to the second gamma curve group in the certain frame.

According to the above configuration, the driving means drives at least part of the plurality of pixels so that, in each of said at least part of the plurality of pixels, (i) at least part of an N-M first sub pixel(s) is/are driven according to one of two different gamma curve groups, the one of the two different gamma curve groups being selected depending on (a) a position(s) where said at least part of the N-M first sub pixel(s) is/are located and (b) in each frame, and (ii) at least part of a second sub pixel(s) is/are driven according to one of the two different gamma curve groups, the another one of the two different gamma curve groups being selected depending on (a) a position(s) where said at least part of the second sub pixel(s) is/are located and (b) in each frame. This allows the gamma characteristics of the N-M first sub pixels to compensate for each other and allows the gamma characteristics of the second sub pixels to compensate for each other, thereby preventing the color deviation which may occur when the display panel is viewed at an angle. This makes it possible to improve the viewing angle characteristic.

Further, according to the above configuration, it is possible to further improve the viewing angle characteristic and also to bring about a viewing angle compensation effect along a time axis. Consequently, it is possible to provide better visibility when the display panel is viewed at an angle and to display an image more smoothly. Further, it is possible to prevent impairment in a visually-sensed resolution more reliably.

Further, the display device according to the one aspect of the present invention is preferably configured such that: the driving means drives, among the plurality of pixels, the other of the plurality of pixels which are not said at least part of the plurality of pixels so that, in each of the other of the plurality of pixels, at least part of an N-M first sub pixel(s) and at least part of a second sub pixel(s) are driven according to the common gamma curve.

Further, as described above, a display device according to one aspect of the present invention is a display device including: a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected in each frame, and (ii) at least part of a second sub pixel(s) is/are driven according to one of the first and second gamma curve groups, the one of the first and second gamma curve groups being selected in each frame, the first gamma curve group being different from the common gamma curve, the second gamma curve group being different from the common gamma curve and the first gamma curve group.

According to the above configuration, the M first sub pixel(s) among the N first sub pixels, which are included in each pixel and display different colors, are uniformly driven by the driving means with use of the common gamma curve. This prevents occurrence of the conventional problems, e.g., the problem of failing to display an oblique line that is to be displayed.

Further, the driving means drives at least part of the plurality of pixels so that, in each of said at least part of the plurality of pixels, (i) at least part of an N-M first sub pixel(s) is/are driven according to one of two different gamma curve groups, the one of the two different gamma curve groups being selected in each frame, and (ii) at least part of a second sub pixel(s) is/are driven according to one of the two different gamma curve groups, the one of the two different gamma curve groups being selected in each frame. This allows gamma characteristics of the N-M first sub pixels to compensate for each other and allows gamma characteristics of the second sub pixels to compensate for each other, thereby preventing the color deviation which may occur when the display panel is viewed at an angle. This makes it possible to improve the viewing angle characteristic.

The driving means drives, among the sub pixels included in each pixel, the M first sub pixel(s) according to the common gamma curve uniformly. Further, the driving means drives, among the sub pixels included in each pixel, only the N-M first sub pixel(s) and the second sub pixel(s) according to corresponding ones of the plurality of gamma curves including the two different gamma curves, the corresponding ones of the plurality of gamma curves being selected in each frame. As compared with a configuration in which all the sub pixels included in each pixel are driven according to corresponding ones of the plurality of gamma curves including the two different gamma curves, the above configuration allows the driving means to have a simple configuration. This makes it possible to provide a reduction in the circuit scale, a reduction in cost, and a reduction in electric power consumption.

Further, according to the above configuration, it is possible to further improve the viewing angle characteristic and also to bring about a viewing angle compensation effect along a time axis. Consequently, it is possible to provide better visibility when the display panel is viewed at an angle and to display an image more smoothly. Further, it is possible to prevent impairment in a visually-sensed resolution more reliably.

Further, the display device according to the one aspect of the present invention is preferably configured such that: in a case where the driving means drives said at least part of the N-M first sub pixel(s) and said at least part of the second sub pixel(s) according to the first gamma curve group in a frame immediately before a certain frame, the driving means drives said at least part of the N-M first sub pixel(s) and said at least part of the second sub pixel(s) according to the second gamma curve group in the certain frame; and in a case where the driving means drives said at least part of the N-M first sub pixel(s) and said at least part of the second sub pixel(s) according to the second gamma curve group in a frame immediately before a certain frame, the driving means drives said at least part of the N-M first sub pixel(s) and said at least part of the second sub pixel(s) according to the first gamma curve group in the certain frame.

According to the above configuration, the driving means drives the second sub pixels according to one of the two different gamma curves selected in each frame, the selection being made so that the two different gamma curves alternate with each other. This brings about a viewing angle compensation effect along a time axis. Consequently, it is possible to provide better visibility when the display panel is viewed at an angle and to display an image smoothly. Further, it is possible to prevent impairment in a visually-sensed resolution.

Further, the display device according to the one aspect of the present invention is preferably configured such that: the first gamma curve group has a gamma characteristic having a higher luminance than that of a gamma characteristic of the common gamma curve; and the second gamma curve group has a gamma characteristic having a lower luminance than that of the gamma characteristic of the common gamma curve.

According to the above configuration, the first gamma curve group has the gamma characteristic having a higher luminance than that of the gamma characteristic of the common gamma curve, and the second gamma curve group has the gamma characteristic having a lower luminance than that of the gamma characteristic of the common gamma curve. This makes it possible to effectively improve the viewing angle characteristic.

Further, the display device according to the one aspect of the present invention is preferably configured such that: the N-M first sub pixel(s) is one first sub pixel displaying blue.

According to the above configuration, it is possible to improve a viewing angle characteristic for a blue component among color components of an image displayed by the display device.

Further, the display device according to the one aspect of the present invention is preferably configured such that: the N-M first sub pixel(s) are two first sub pixels respectively displaying (i) blue and red or (ii) blue and green.

According to the above configuration, it is possible to improve viewing angle characteristics for (i) blue and red components or (ii) blue and green components among color components of an image displayed by the display device.

Further, the display device according to the one aspect of the present invention is preferably configured such that: the N first sub pixels are three first sub pixels respectively displaying blue, red, and green; and the second sub pixel(s) display(s) white.

According to the above configuration, it is possible to improve viewing angle characteristics for (i) at least one of blue, red, and green components and (ii) a white component among color components of an image displayed by the display device.

Further, the display device according to the one aspect of the present invention is preferably configured such that: the N first sub pixels are three first sub pixels respectively displaying blue, red, and green; and the second sub pixel(s) display(s) yellow.

According to the above configuration, it is possible to improve viewing angle characteristics for (i) at least one of blue, red, and green components and (ii) a yellow component among color components of an image displayed by the display device.

INDUSTRIAL APPLICABILITY

The present invention is capable of (i) displaying an image which is closer to an image desired to be displayed and (ii) economically preventing color deviation which may occur when a display panel is viewed at an angle. Therefore, the present invention is applicable to a wide variety of devices for displaying an image (e.g., liquid crystal display devices).

REFERENCE SIGNS LIST

1, 2 Display device
10 Display panel
20 Driving section (driving means)
30 Display region
31 Pixel
31*a* Pixel group (first pixel group)
31*b* Pixel group (second pixel group)
31*c* Pixel group
32*a* Pixel group
32*b* Pixel group
41 R pixel (first sub pixel)
42 G pixel (first sub pixel)
43 B pixel (first sub pixel)
44 W pixel (second sub pixel)
61*a* Pixel group (first pixel group)
61*b* Pixel group (second pixel group)
61*c* Pixel group
70 Display region
71 Pixel
71*a* Pixel group (first pixel group)
71*b* Pixel group (second pixel group)
75 R pixel (first sub pixel)
76 G pixel (first sub pixel)
76 B pixel (first sub pixel)
78 Y pixel (second sub pixel)
80 Display region
81 Pixel
81*a* Pixel group (first pixel group)
81*b* Pixel group (second pixel group)
85 R pixel (first sub pixel)
86 G pixel (first sub pixel)
87 B pixel (first sub pixel)
88 W pixel (second sub pixel)

The invention claimed is:

1. A display device comprising:

a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected depending on a position(s) where said at least part of the N-M first sub pixel(s) is/are located, and (ii) at least part of a second sub pixel(s) is/are driven according to one of the first and second gamma curve groups, the one of the first and second gamma curve groups being selected depending on a position(s) where said at least part of the second sub pixel(s) is/are located, the first gamma curve group being different from the common gamma curve, the second gamma curve group being different from the common gamma curve and the first gamma curve group.

2. The display device as set forth in claim 1, wherein:

the plurality of pixels constitute a plurality of pixel groups being located in different positions, the plurality of pixel groups including a first pixel group and a second pixel group;

the driving means drives an N-M first sub pixel(s) and a second sub pixel(s) of a pixel in the first pixel group according to the first gamma curve group; and the driving means drives an N-M first sub pixel(s) and a second sub pixel(s) of a pixel in the second pixel group according to the second gamma curve group.

3. The display device as set forth in claim 1, wherein:

the plurality of pixels constitute a plurality of pixel groups being located in different positions, the plurality of pixel groups including a first pixel group and a second pixel group;

in a case where the driving means drives an N-M first sub pixel(s) and a second sub pixel(s) of a pixel in the first pixel group according to the first gamma curve group and drives an N-M first sub pixel(s) and a second sub pixel(s) of a pixel in the second pixel group according to the second gamma curve group in a frame immediately before a certain frame, the driving means drives the N-M first sub pixel(s) and the second sub pixel(s) of the pixel in the first pixel group according to the second gamma curve group and drives the N-M first sub pixel(s) and the second sub pixel(s) of the pixel in the second pixel group according to the first gamma curve group in the certain frame; and in a case where the driving means drives an N-M first sub pixel(s) and a second sub pixel(s) of a pixel in the first pixel group according to the second gamma curve group and drives an N-M first sub pixel(s) and a second sub pixel(s) of a pixel in the second pixel group according to the first gamma curve group in a frame immediately before a certain frame, the driving means drives the N-M first sub pixel(s) and the second sub pixel(s) of the pixel in the first pixel group according to the first gamma curve group and drives the N-M first sub pixel(s) and the second sub pixel(s) of the pixel in the second pixel group according to the second gamma curve group in the certain frame.

4. The display device as set forth in claim 1, wherein:

the driving means drives, among the plurality of pixels, the other of the plurality of pixels which are not said at least part of the plurality of pixels so that, in each of the other of the plurality of pixels, at least part of an N-M first sub pixel(s) and at least part of a second sub pixel(s) are driven according to the common gamma curve.

5. A display device comprising:

a display panel including a plurality of pixels; and driving means for driving the plurality of pixels, each of the plurality of pixels being constituted by (i) N first sub pixels for displaying different colors and (ii) a second sub pixel(s) for displaying a mixture of colors displayed by any ones of the N first sub pixels, where N is a natural number of two or more, the driving means driving each of the plurality of pixels so that an M first sub pixel(s) of the N first sub pixels is/are driven according to a common gamma curve having a predetermined gamma characteristic, where M is a natural number of $1 \leq M \leq N-1$, the driving means driving at least part of the plurality of pixels so that, in each of said at least part of the plurality of pixels, (i) at least part of an N-M first sub pixel(s) is/are driven according to one of first and second gamma curve groups, the one of the first and second gamma curve groups being selected in each frame, and (ii) at least part of a second sub pixel(s) is/are driven according to one of the first and second gamma curve groups, the one of the first and second gamma curve groups being selected in each frame, the first gamma curve group being different from the common gamma curve, the second gamma curve group being different from the common gamma curve and the first gamma curve group.

6. The display device as set forth in claim 5, wherein:

in a case where the driving means drives said at least part of the N-M first sub pixel(s) and said at least part of the second sub pixel(s) according to the first gamma curve group in a frame immediately before a certain frame, the driving means drives said at least part of the N-M first sub pixel(s) and said at least part of the second sub pixel(s) according to the second gamma curve group in the certain frame; and in a case where the driving means drives said at least part of the N-M first sub pixel(s) and said at least part of the second sub pixel(s) according to the second gamma curve group in a frame immediately before a certain frame, the driving means drives said at least part of the N-M first sub pixel(s) and said at least part of the second sub pixel(s) according to the first gamma curve group in the certain frame.

7. The display device as set forth in claim 1, wherein:

the first gamma curve group has a gamma characteristic having a higher luminance than that of a gamma characteristic of the common gamma curve; and the second gamma curve group has a gamma characteristic having a lower luminance than that of the gamma characteristic of the common gamma curve.

8. The display device as set forth in claim 1, wherein:

the N-M first sub pixel(s) is one first sub pixel displaying blue.

9. The display device as set forth in claim 1, wherein:

the N-M first sub pixel(s) are two first sub pixels respectively displaying (i) blue and red or (ii) blue and green.

10. The display device as set forth in claim 1, wherein:

the N first sub pixels are three first sub pixels respectively displaying blue, red, and green; and the second sub pixel(s) display(s) white.

11. The display device as set forth in claim 1, wherein:

the N first sub pixels are three first sub pixels respectively displaying blue, red, and green; and the second sub pixel(s) display(s) yellow.

* * * * *